US008583005B2

(12) United States Patent
Asanuma et al.

(10) Patent No.: US 8,583,005 B2
(45) Date of Patent: Nov. 12, 2013

(54) PROCESS CARTRIDGE AND IMAGE FORMING APPARATUS

(75) Inventors: Naoya Asanuma, Susono (JP); Yoshiyuki Batori, Mishima (JP); Naoki Matsumaru, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/224,793

(22) Filed: Sep. 2, 2011

(65) Prior Publication Data

US 2012/0057899 A1 Mar. 8, 2012

(30) Foreign Application Priority Data

Sep. 6, 2010 (JP) ..... 2010-198777
Aug. 4, 2011 (JP) ..... 2011-171109

(51) Int. Cl.
*G03G 21/16* (2006.01)
*G03G 21/18* (2006.01)

(52) U.S. Cl.
USPC ..... 399/111; 399/113

(58) Field of Classification Search
USPC ..... 399/111, 113, 119
See application file for complete search history.

(56) References Cited

U.S. PATENT DOCUMENTS

| | | | |
|---|---|---|---|
| 6,336,012 | B1 | 1/2002 | Noda et al. |
| 6,385,413 | B2 | 5/2002 | Sasaki et al. |
| 6,915,091 | B2 | 7/2005 | Matsumaru et al. |
| 7,039,338 | B2 | 5/2006 | Batori et al. |
| 7,336,914 | B2 | 2/2008 | Batori et al. |

FOREIGN PATENT DOCUMENTS

| | | | |
|---|---|---|---|
| CN | 1510527 | A | 7/2004 |
| EP | 1050783 | A2 | 11/2000 |
| JP | 56-155952 | A | 12/1981 |
| JP | 8-339149 | A | 12/1996 |
| JP | 9-50224 | A | 2/1997 |
| JP | 2001-066970 | A | 3/2001 |
| JP | 4053194 | B2 | 2/2008 |

OTHER PUBLICATIONS

Notification of Transmittal of the International Search Report and the Written Opinion of the International Searching Authority, or the Declaration mailed Feb. 13, 2012, forwarding the International Search Report and the Written Opinion of the International Searching Authority, in International Application No. PCT/JP2011/070677.
Chinese Office Action dated Aug. 30, 2013, in related Chinese Patent Application No. 201180042212.0 (with English translation).

*Primary Examiner* — David Gray
*Assistant Examiner* — Erika J Villaluna
(74) *Attorney, Agent, or Firm* — Fizpatrick, Cella, Harper & Scinto

(57) ABSTRACT

A process includes an image bearing member unit; a developing unit; a shaft provided in either the image bearing member unit or the developing unit at an end portion of the process cartridge with respect to an image bearing member axial direction; and an opening, provided in the unit at the end portion, engaged with the shaft to permit movement of the developing unit relative to the image bearing member unit. The opening defines a first contact portion, when the process cartridge is mounted to a main assembly, contacting the shaft to permit movement of the developing unit, and defines a second contact portion, when the second contact portion contacts the shaft when the process cartridge is mounted to the main assembly and does not receive a driving force from the main assembly, contacting the developing unit so the shaft and the first contact portion are in contact.

11 Claims, 34 Drawing Sheets

(a)

(b)

(a)

(b)

(a)

(b)

(a)

(b)

(a)

(b)

PROCESS CARTRIDGE AND IMAGE FORMING APPARATUS

FIELD OF THE INVENTION AND RELATED ART

The present invention relates to a process cartridge and an image forming apparatus. In the present invention, the process cartridge refers to a cartridge prepared by integrally assembling an image bearing member unit including an image bearing member and a developing unit including a developer carrying member.

Incidentally, the image bearing member is an electrophotographic photosensitive member, an electrostatic recording dielectric member, a magnetic recording magnetic member or the like. The developer carrying member carries a developer and develops, with the developer, a latent image (electrostatic latent image, potential image, magnetic latent image, or the like) formed on the image bearing member by an appropriate method.

The image forming apparatus forms an image on a recording material (medium). Examples of the image forming apparatus may include an electrophotographic image forming apparatus. A main assembly of the image forming apparatus refers to an image forming apparatus portion excluding the process cartridge.

In a conventional image forming apparatus using an electrophotographic image forming process, a process cartridge type in which a photosensitive drum and a process means acting on the photosensitive drum are integrally assembled into a cartridge which is detachably mountable to the main assembly of the image forming apparatus is employed.

As the process cartridge, one in which the image bearing member unit for holding the photosensitive drum and a cleaning means or the like and the developing unit for holding a pressure which is the developer carrying member are connected by a connecting member is generally known. In this process cartridge, the developing unit is supported rotatably relative to the image bearing member unit by using the connecting member as an axis (shaft) of rotational movement and is urged toward the image bearing member unit by its own weight or an urging member such as a spring. The developing roller in the developing unit is contactable to the photosensitive drum in the image bearing member unit with certain pressure, so that the image forming apparatus can stably from the image.

However, in such a process cartridge, by the influence of component tolerance or the like, a position of the connecting member for connecting the image bearing member unit and the developing unit or a position of a hole in which the connecting member is engaged is deviated from a target dimension during design (hereinafter referred to as a reference dimension) in some cases. When the position of the connecting member or the like is deviated, the connection between the image bearing member unit and the developing unit is influenced and thus there is a possibility that the pressure of the developing roller exerted on the photosensitive drum is also fluctuated from a designed value.

For that reason, in the conventional process cartridge, as described in Japanese Laid-Open Patent Applications (JP-A) Hei 08-339149 and Hei 09-050224, countermeasures to shape a hole to be engaged with the connecting member into an elongated hole have been taken. As a result, even in the case where the position of the connecting member or the like is deviated from the reference dimension, an engaging position between the elongated hole and the connecting member is moved when the connecting member and the elongated hole are engaged with each other, so that resultant positional deviation can be absorbed. As a result, the pressure of the developing roller applied to the photosensitive drum is stabilized.

SUMMARY OF THE INVENTION

The present invention provides a further development of the above-described conventional constitution.

In the process cartridge prepared by integrally connecting the developing unit and the image bearing member unit, when a force was applied from the outside to the process cartridge, the developing unit was moved relative to the image bearing member unit in some cases. In these cases, the pressure of the developer carrying member applied to the image bearing member fluctuates.

A principal object of the present invention is to provide a process cartridge capable of suppressing the pressure fluctuation.

Another object of the present invention is to provide an image forming apparatus including the process cartridge.

According to an aspect of the present invention, there is provided a process cartridge detachably mountable to a main assembly of an image forming apparatus, comprising:

(a) an image bearing member unit including an image bearing member rotatably provided;

(b) a developing unit including a developer carrying member for carrying a developer;

(c) a shaft provided in one of the image bearing member unit and the developing unit at an end portion of the process cartridge with respect to an axial direction of the image bearing member; and (d) an opening, provided in the other unit at the end portion, engaged with the shaft to permit movement of the developing unit relative to the image bearing member unit, wherein the opening defines a first contact portion, in a state in which the process cartridge is mounted to the main assembly, contacting the shaft to permit rotational movement of the developing unit relative to the image bearing member unit, and defines a second contact portion which receives normal reaction from the shaft in a direction inclined with respect to a direction of normal reaction received from the shaft by the first contact portion and which moves, when the second contact portion contacts the shaft in a state in which the process cartridge is mounted to the main assembly and does not receive a driving force from the main assembly, the developing unit so that the shaft and the first contact portion are contacted to each other.

According to another aspect of the present invention, there is provided an image forming apparatus for forming an image on a recording material, comprising:

a process cartridge detachably mountable to a main assembly of an image forming apparatus, wherein the process cartridge includes:

an image bearing member unit including an image bearing member rotatably provided;

a developing unit including a developer carrying member for carrying a developer;

a shaft provided in one of the image bearing member unit and the developing unit at an end portion of the process cartridge with respect to an axial direction of the image bearing member; and an opening, provided in the other unit at the end portion, engaged with the shaft to permit movement of the developing unit relative to the image bearing member unit, wherein the opening defines a first contact portion, in a state in which the process cartridge is mounted to the main assembly, contacting the shaft to permit rotational movement of the developing unit relative to the image bearing member unit, and defines a second contact portion which receives normal reaction from the shaft in a direction inclined with respect to a direction of normal reaction received from the shaft by the first contact portion and which moves, when the second contact portion contacts the shaft in a state in which the process cartridge is mounted to the main assembly and does not receive a driving force from the main assembly, the developing unit so that the shaft and the first contact portion are contacted to each other; and conveying means for conveying the recording material.

These and other objects, features and advantages of the present invention will become more apparent upon a consideration of the following description of the preferred embodiments of the present invention taken in conjunction with the accompanying drawings.

Figure 7:
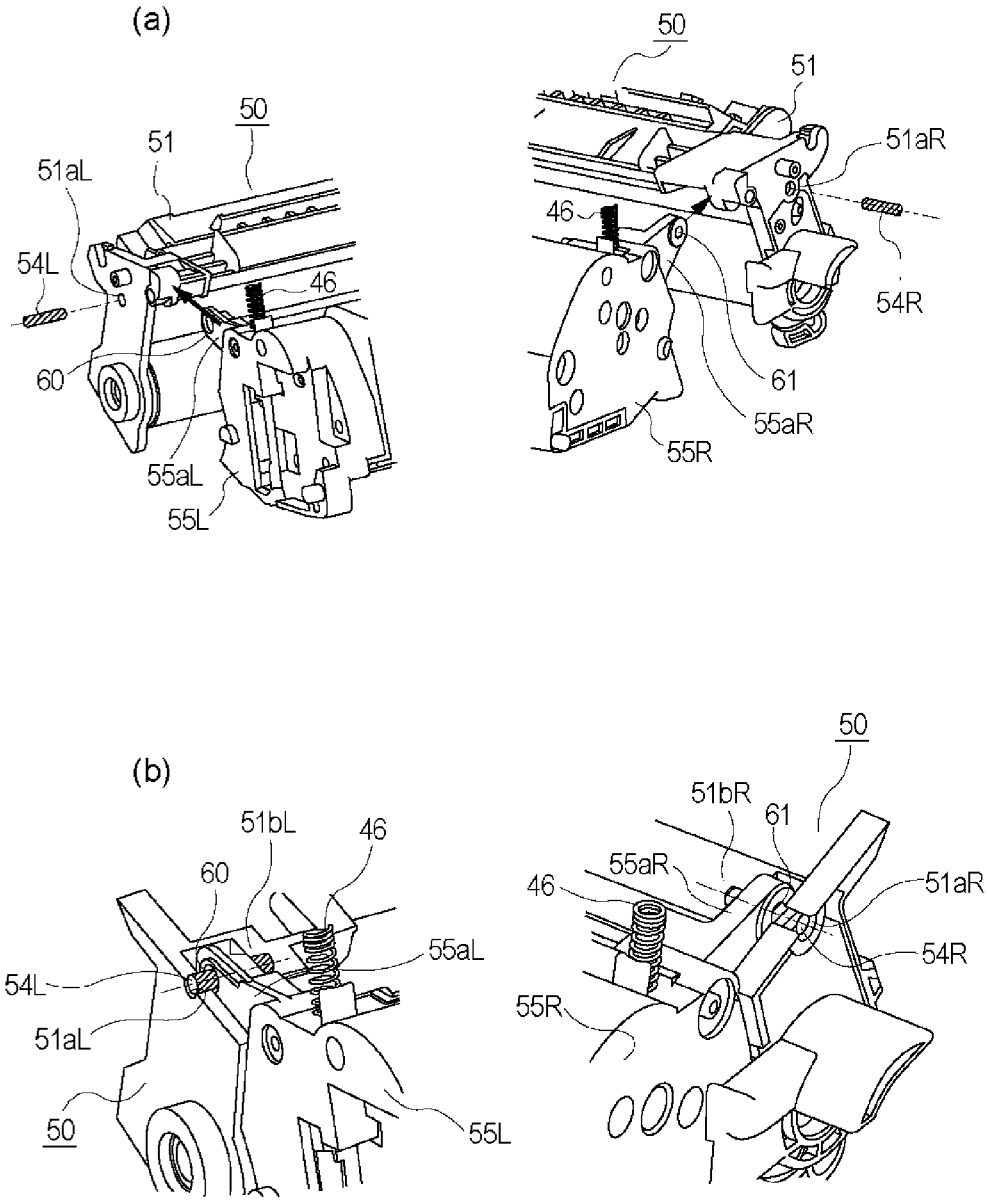

Parts (a) and (b) of FIG. 7 are schematic perspective views for illustrating a connecting portion between the image bearing member unit and the developing unit.

Figure 8:
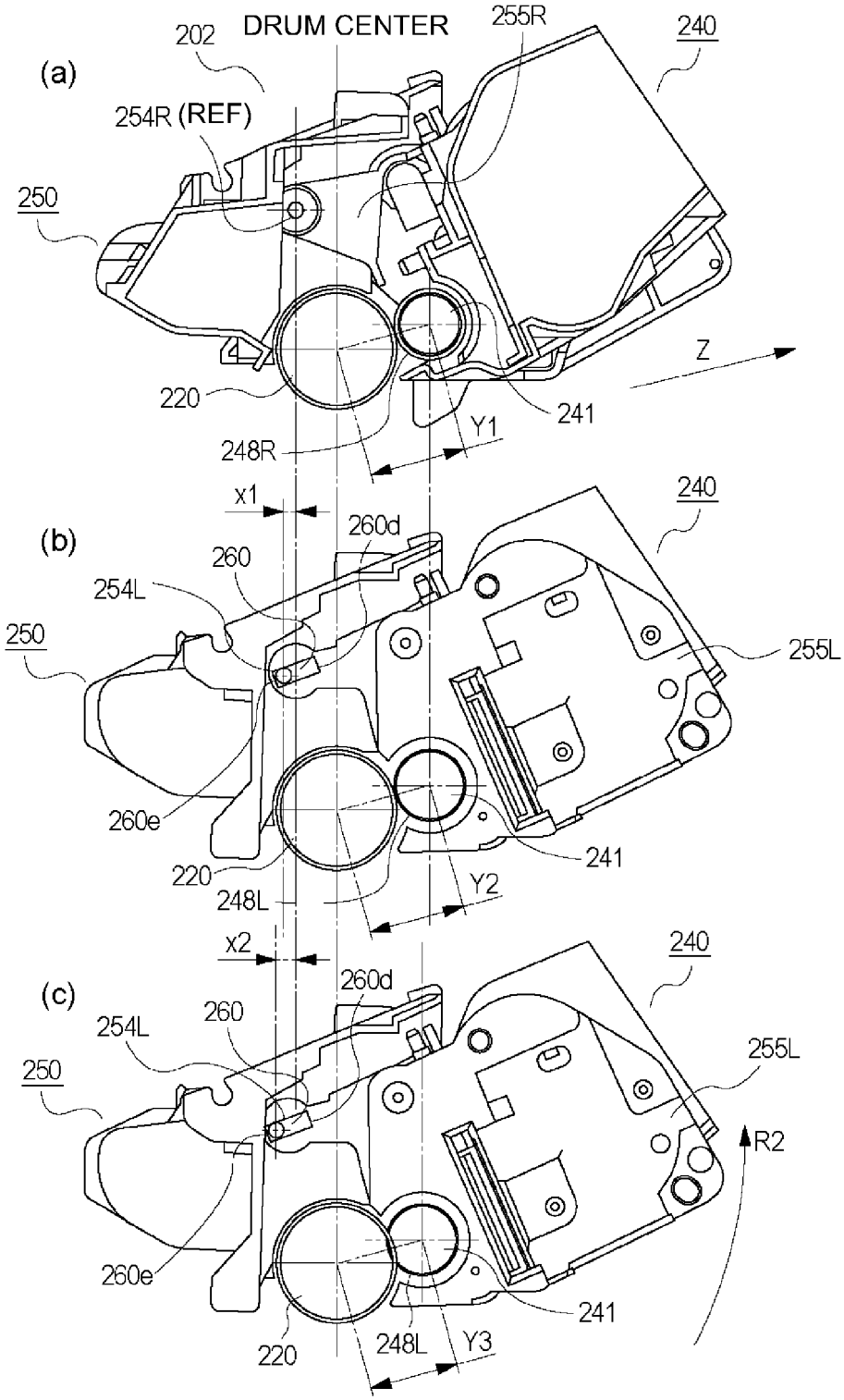

Parts (a) to (c) of FIG. 8 are schematic schematic views of a process cartridge in Comparative Embodiment.

Figure 9:
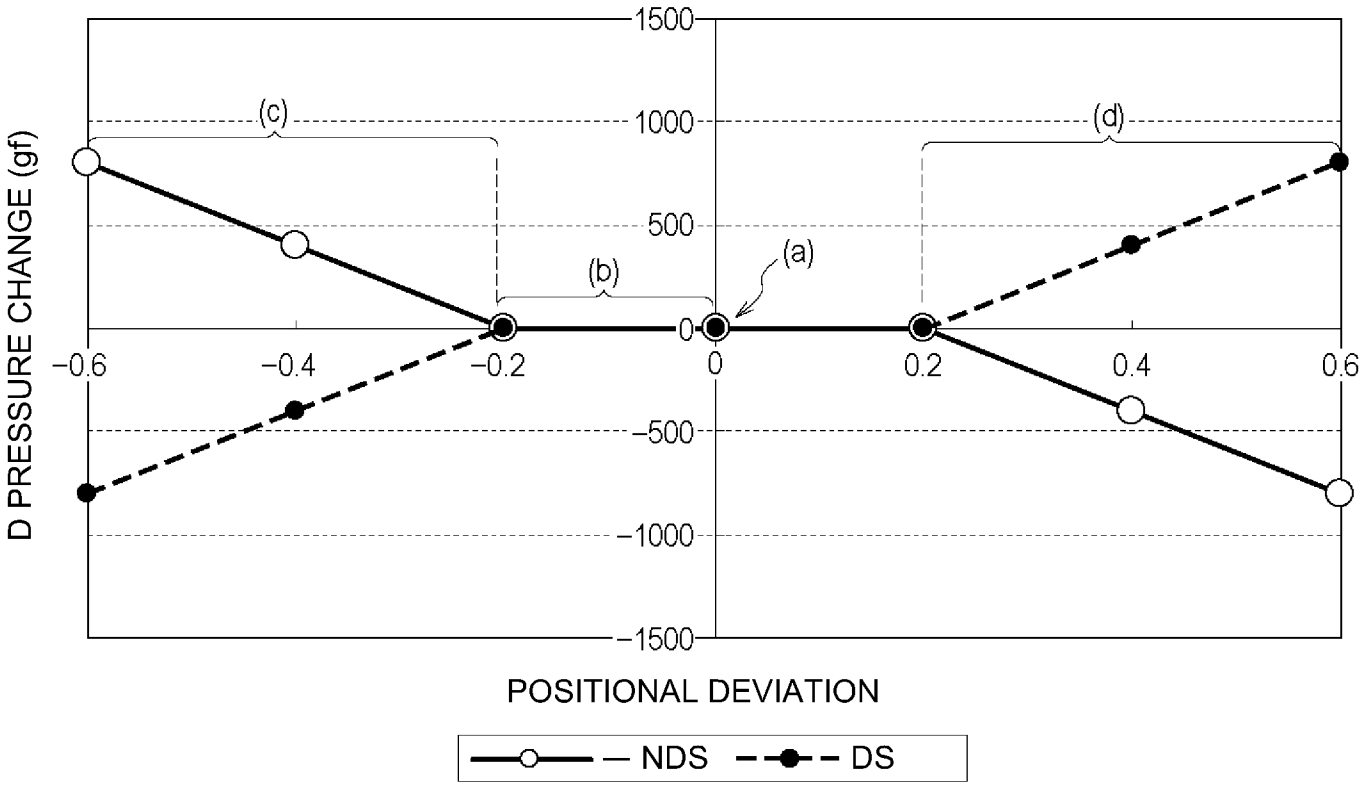

FIG. 9 is a graph for illustrating a change in D pressure (exerted from a developing roller to a photosensitive drum) in Comparative Embodiment.

Figure 10:
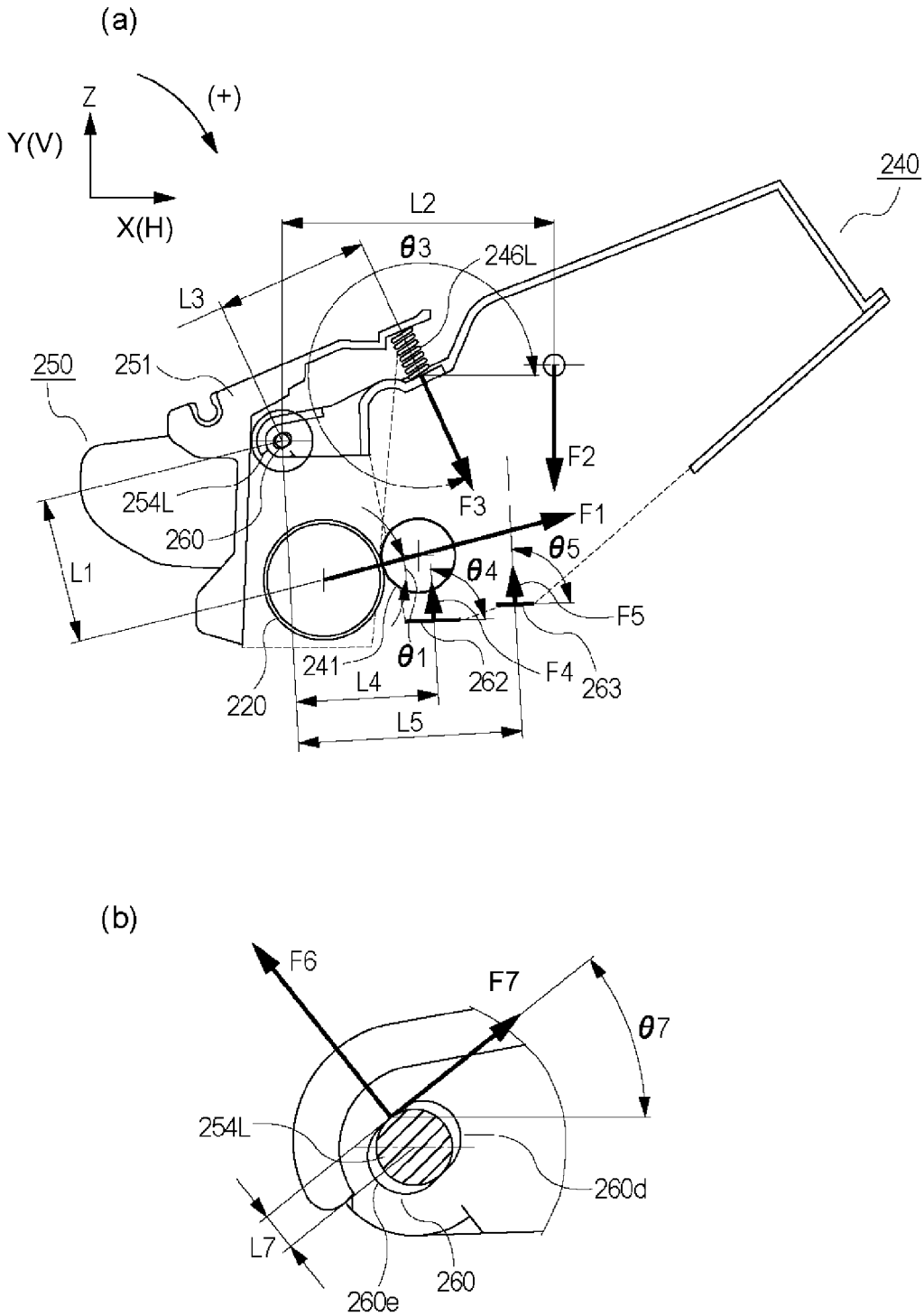

Parts (a) and (b) of FIG. 10 for illustrating a force exerted on the developing unit.

Figure 11:
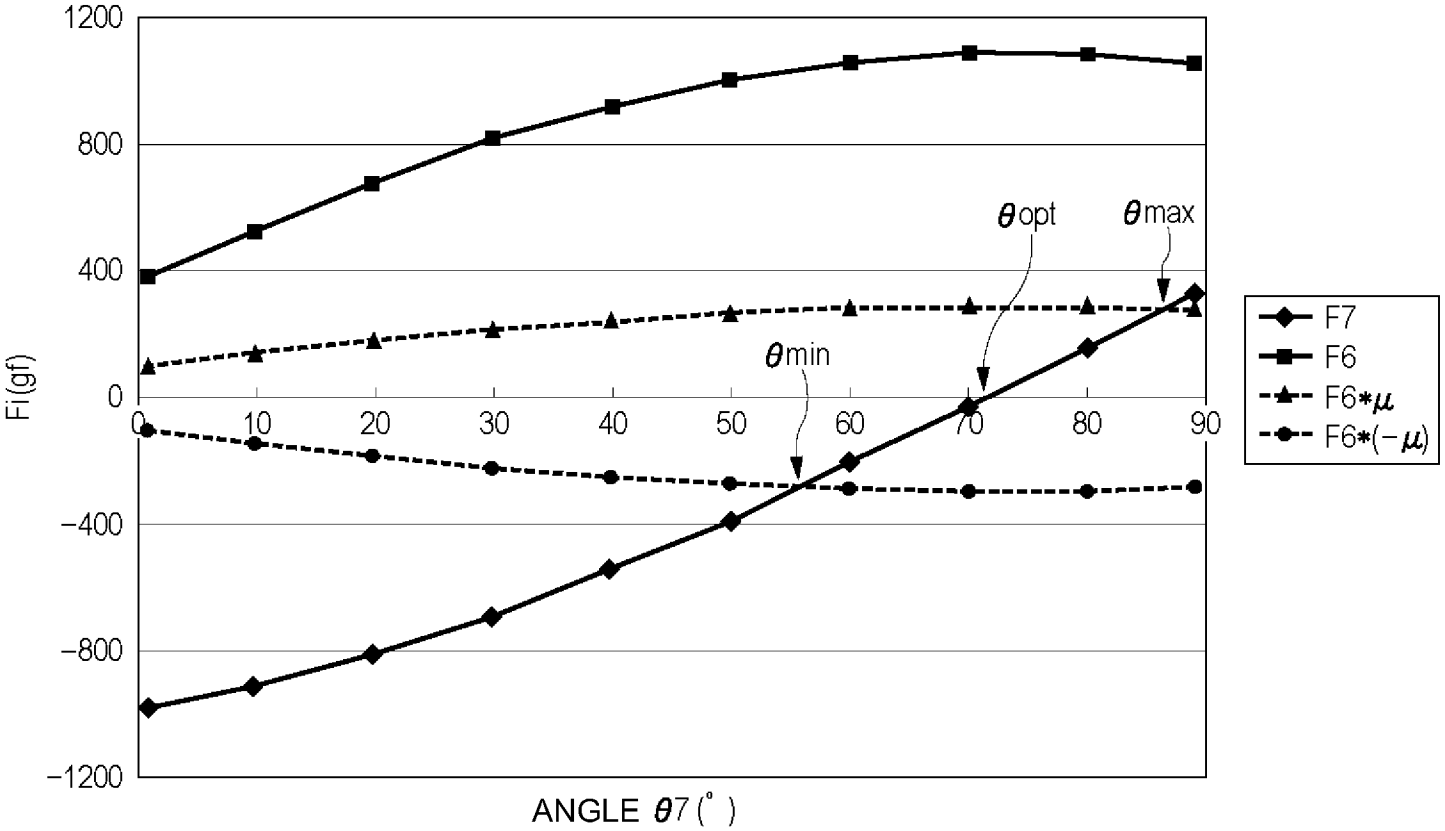

FIG. 11 is a graph showing a developing unit in Comparative Embodiment.

Figure 12:
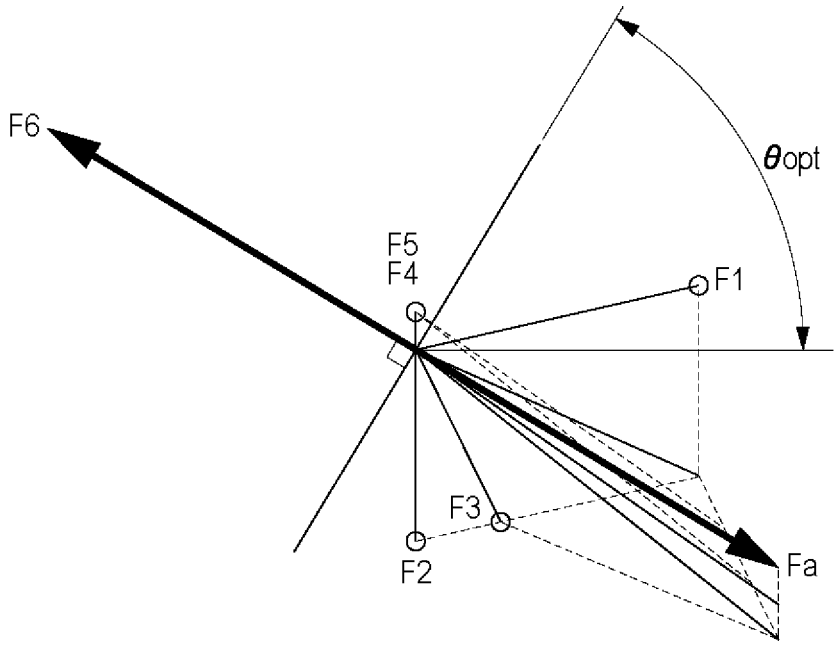

FIG. 12 is a schematic view showing the force exerted on the developing unit and a direction of the force in Comparative Embodiment.

Figure 13:
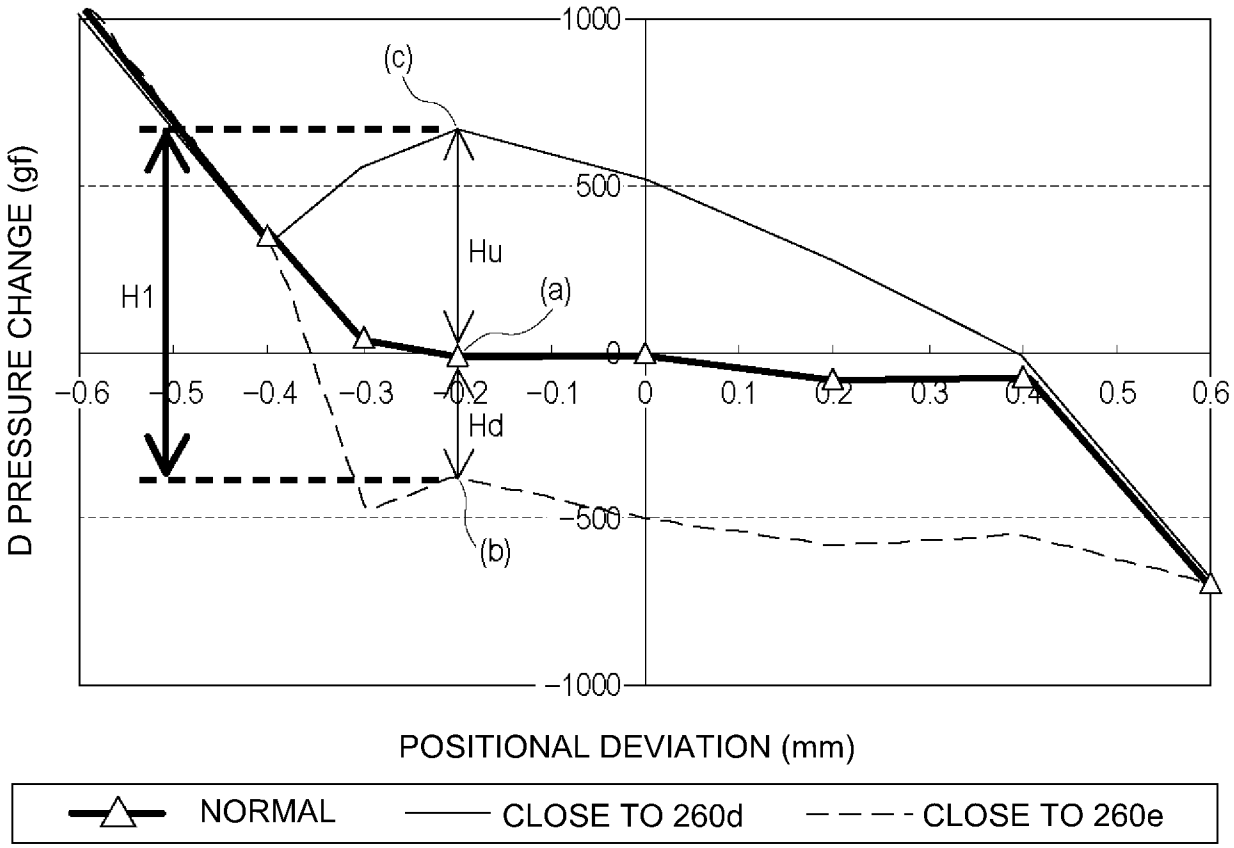

FIG. 13 is a graph showing a fluctuation in D pressure in Comparative Embodiment.

Figure 14:
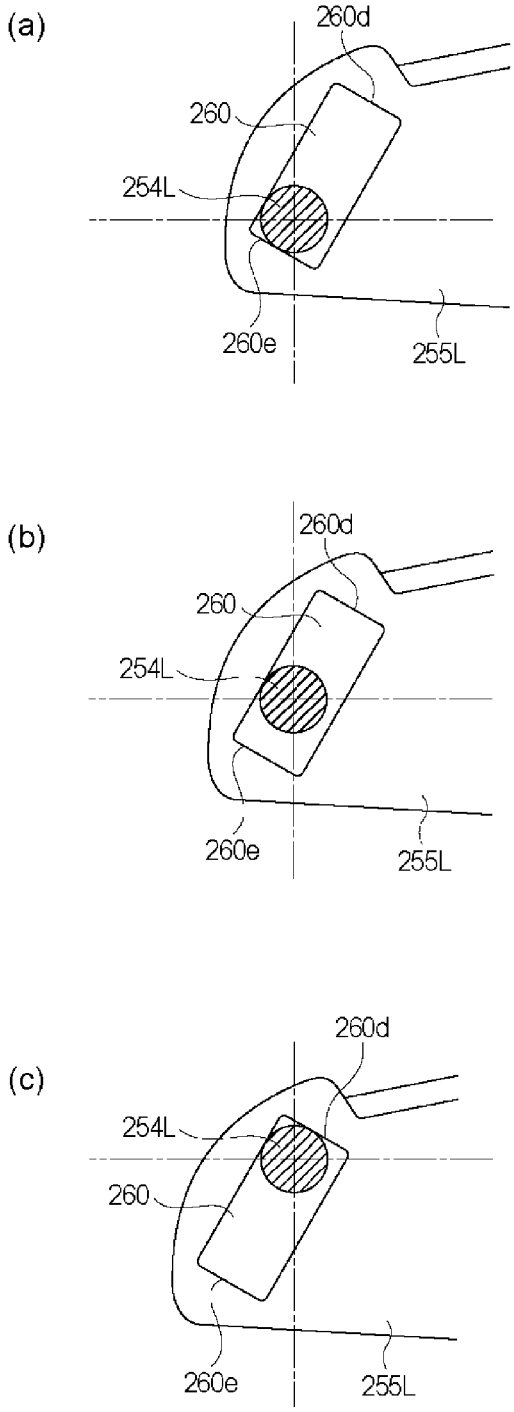

Parts (a) to (c) of FIG. 14 are schematic schematic views showing an engaging position between an opening and a connecting member in Comparative Embodiment.

Figure 15:
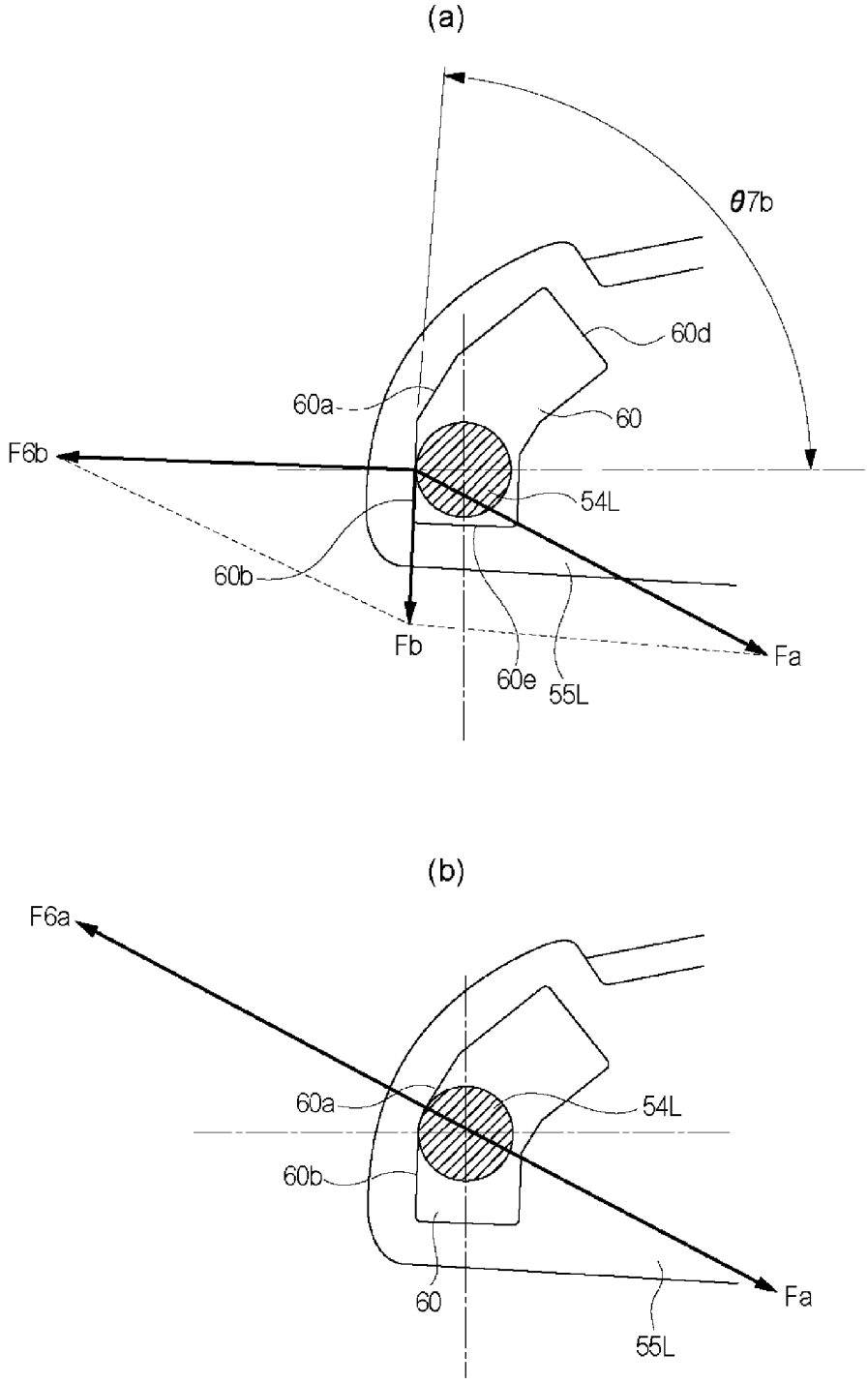
Figure 16:
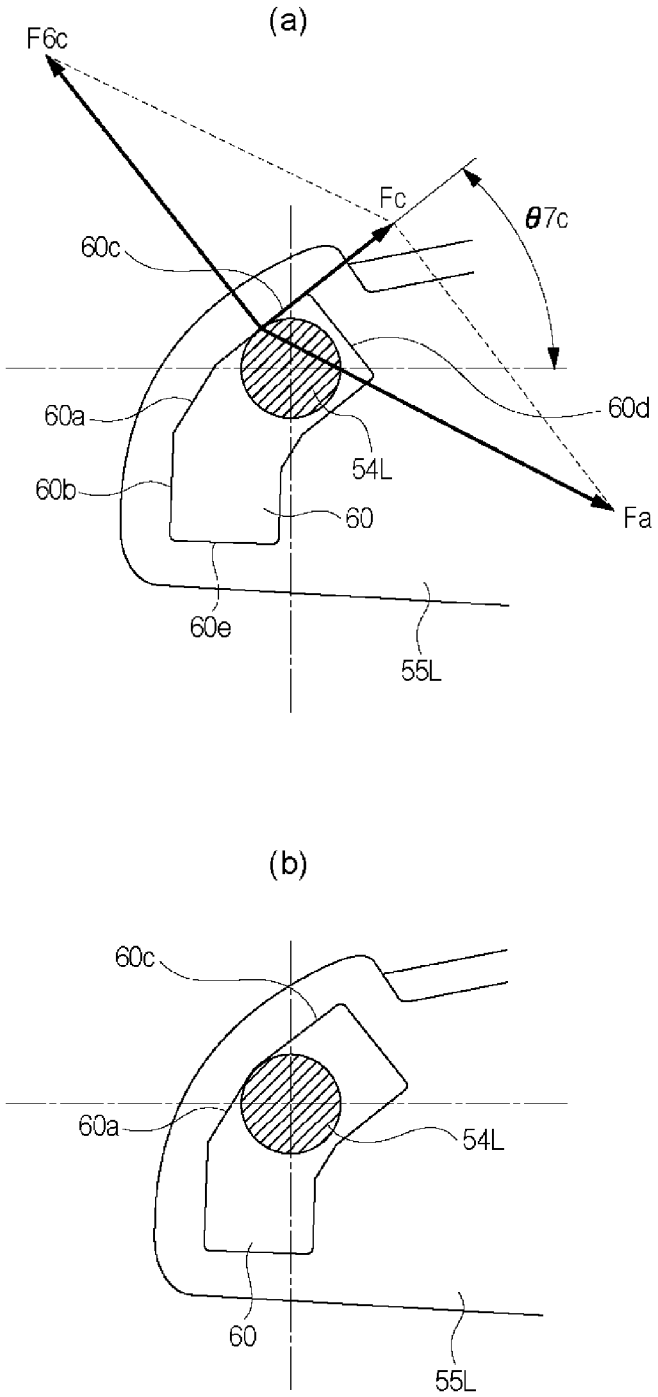

Parts (a) and (b) of FIG. 15 and (a) and (b) of FIG. 16 are schematic schematic views for illustrating setting of engagement between a connecting member and an opening in Embodiment 1.

Figure 17:
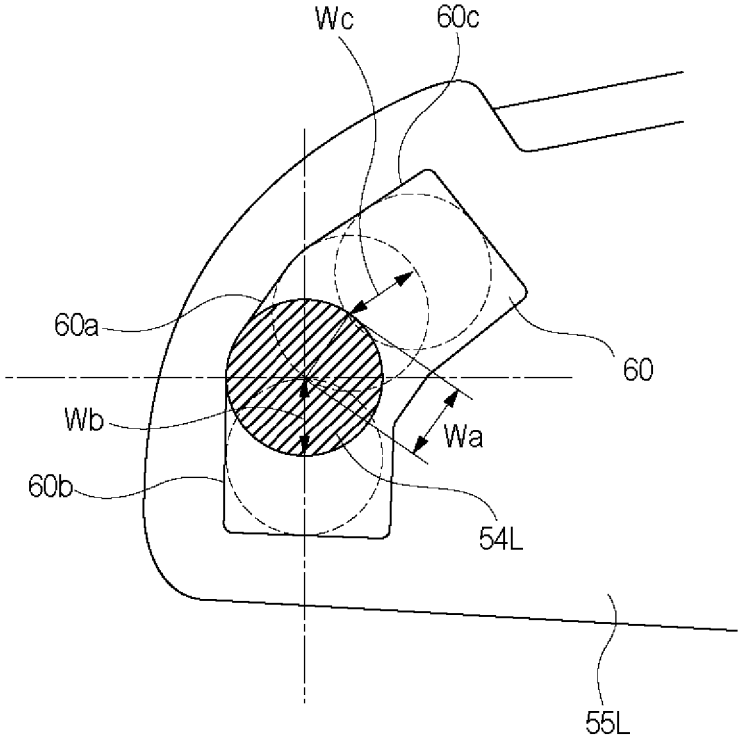

FIG. 17 is a schematic view for illustrating a shape of the opening in Embodiment 1.

Figure 18:
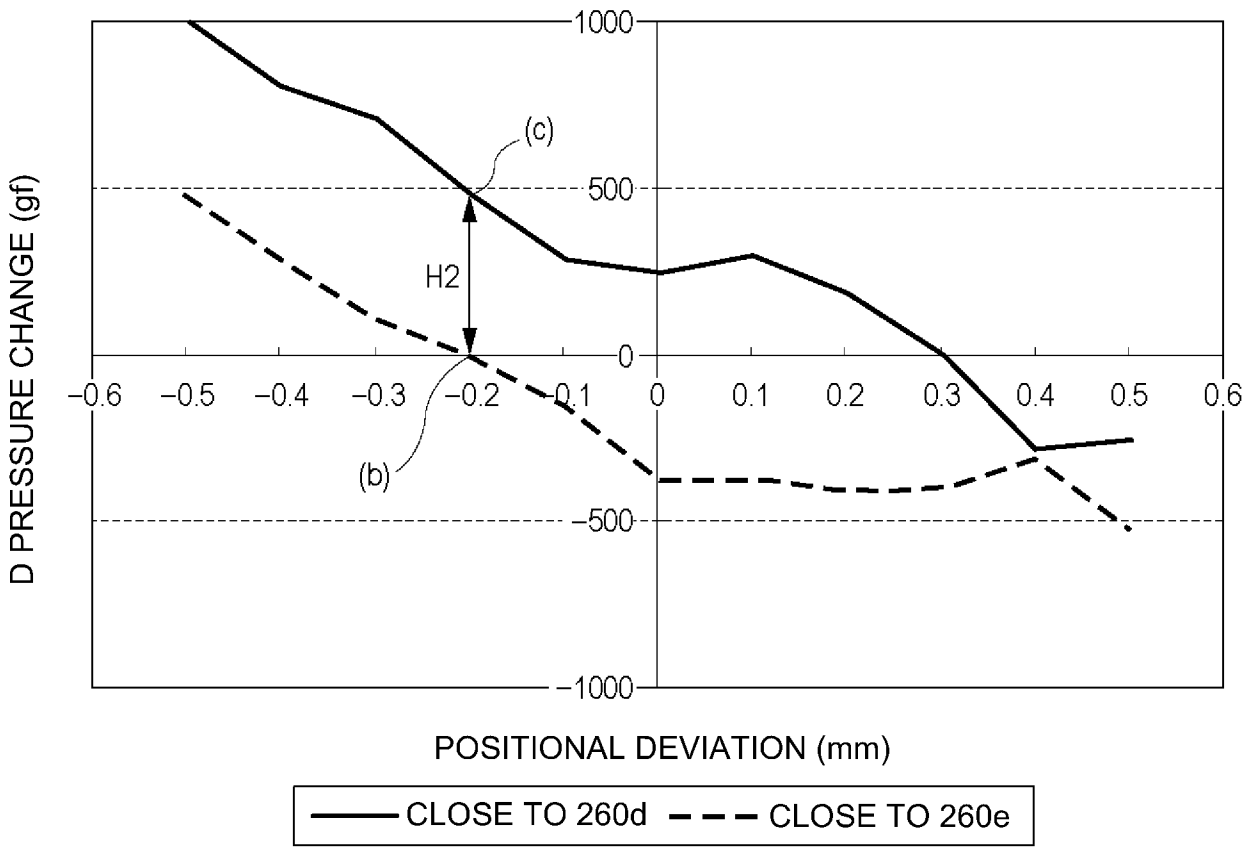

FIG. 18 is a graph showing a fluctuation in D pressure in Embodiment 1.

Figure 19:
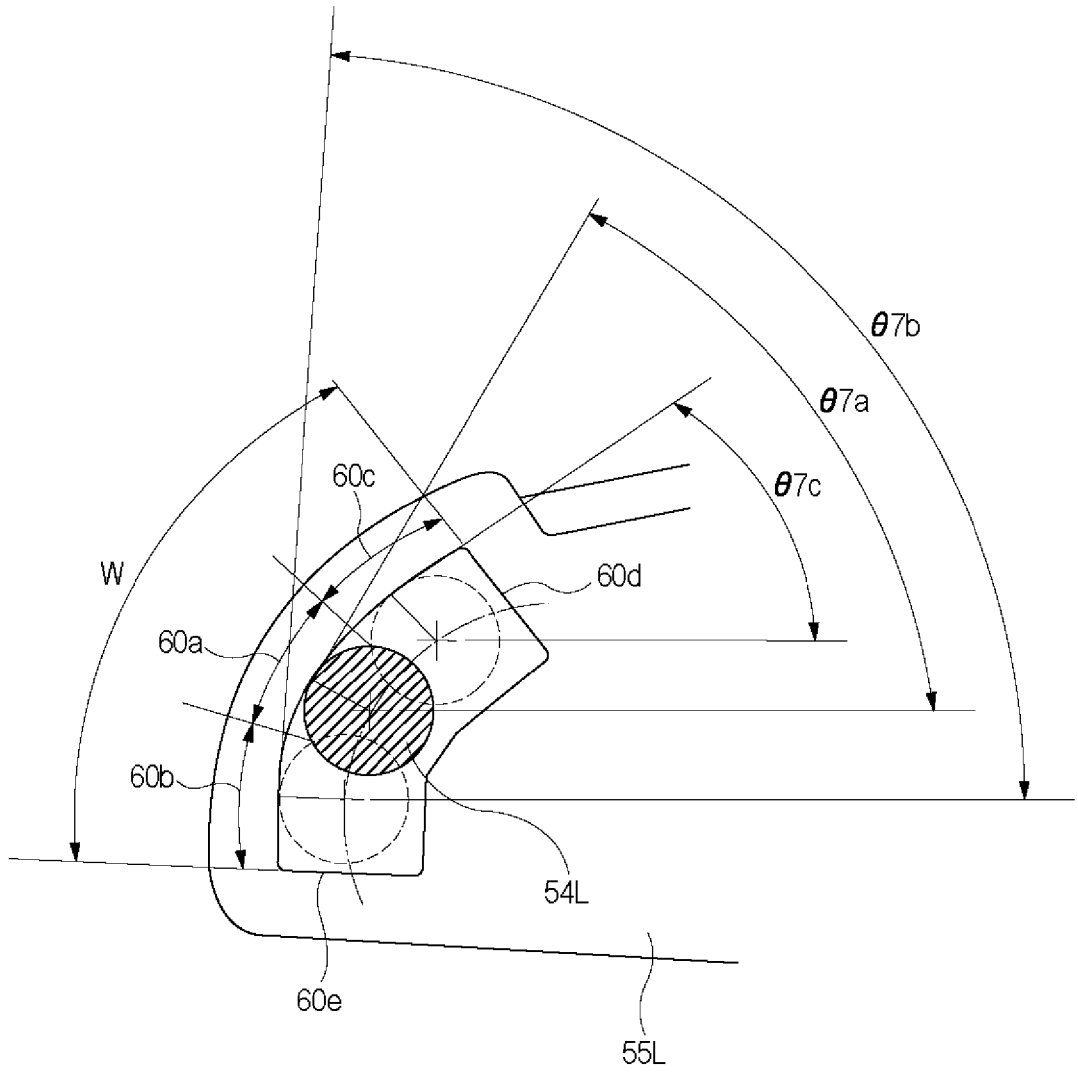

FIG. 19 is a schematic view for illustrating a shape of the opening in Embodiment 2.

Figure 20:
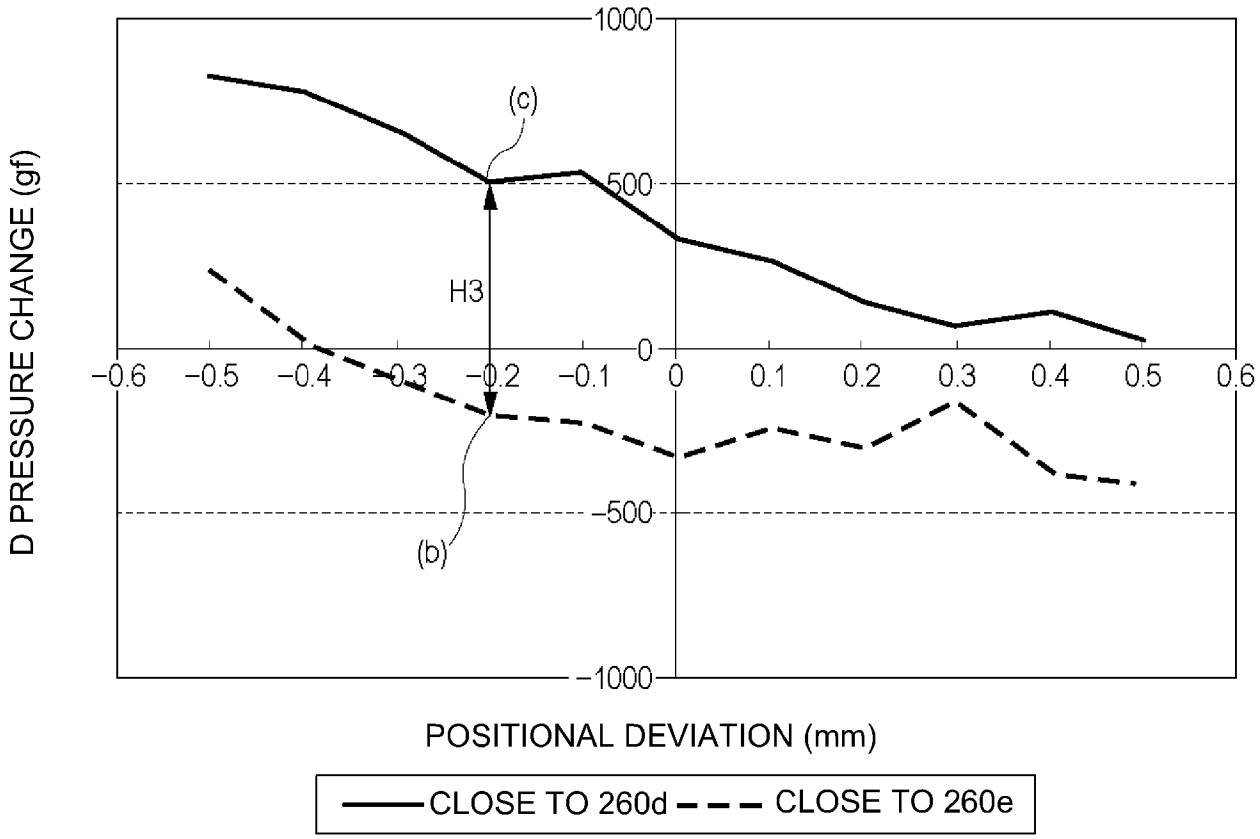

FIG. 20 is a graph showing a fluctuation in D pressure in Embodiment 2.

Figure 21:
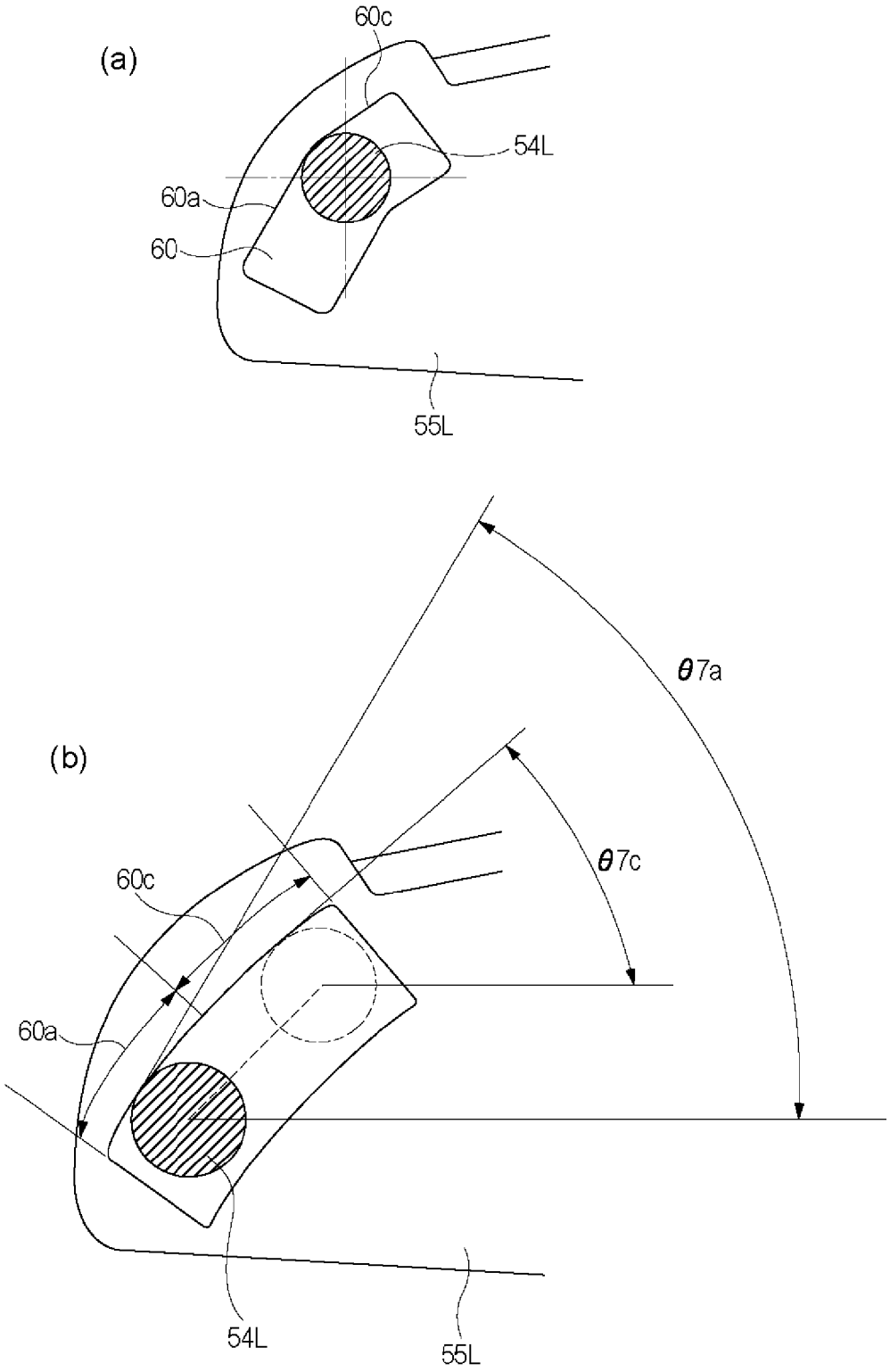

Parts (a) and (b) of FIG. 21 are schematic schematic views for illustrating a shape of the opening in Embodiment 3.

Figure 22:
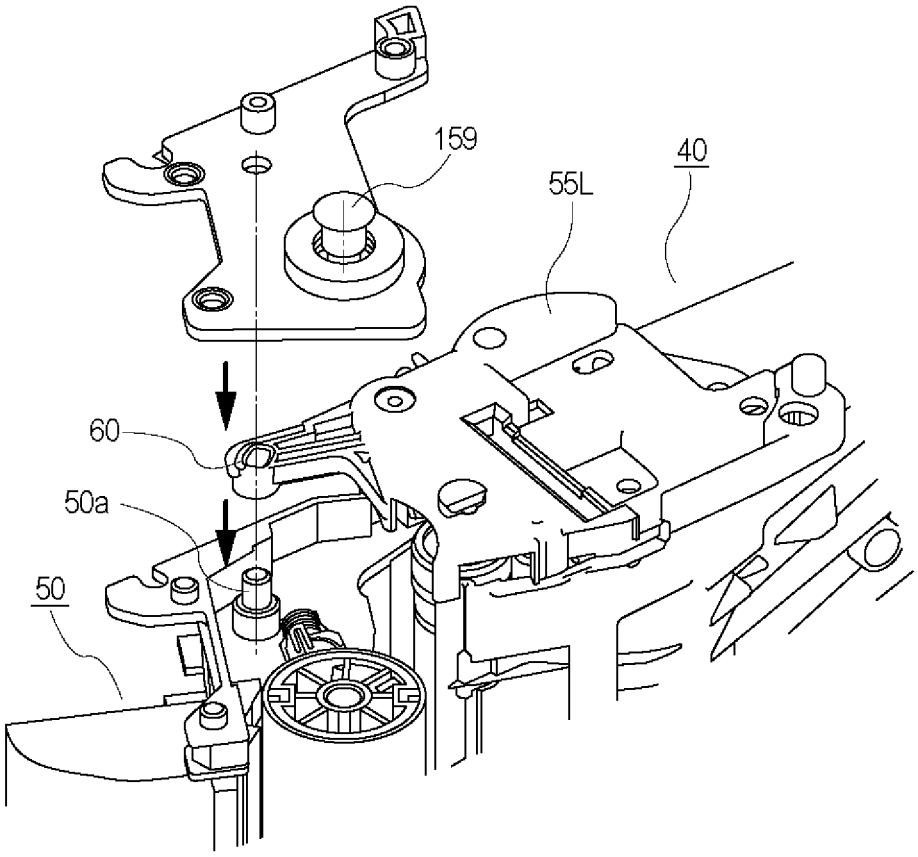

FIG. 22 is a perspective view showing the process cartridge provided with a projection engageable with the opening.

Figure 23:
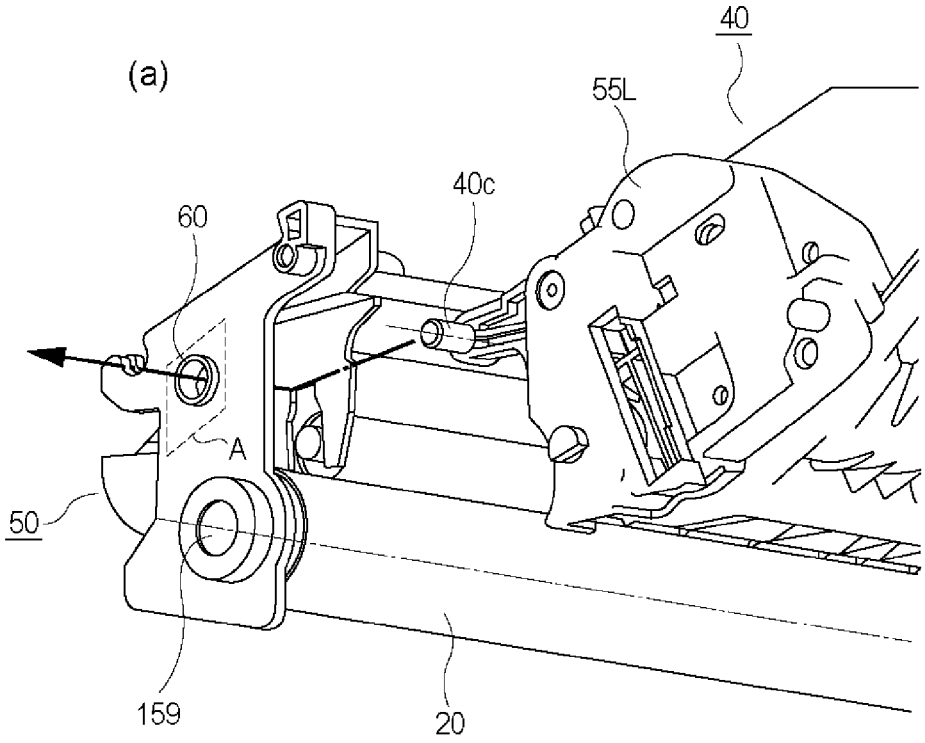
Figure 23:
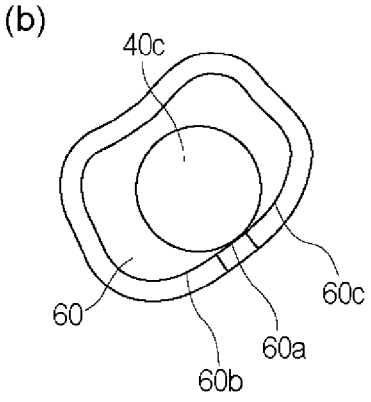

Parts (a) and (b) of FIG. 23 are perspective views for illustrating a process cartridge in Embodiment 4.

Figure 24:
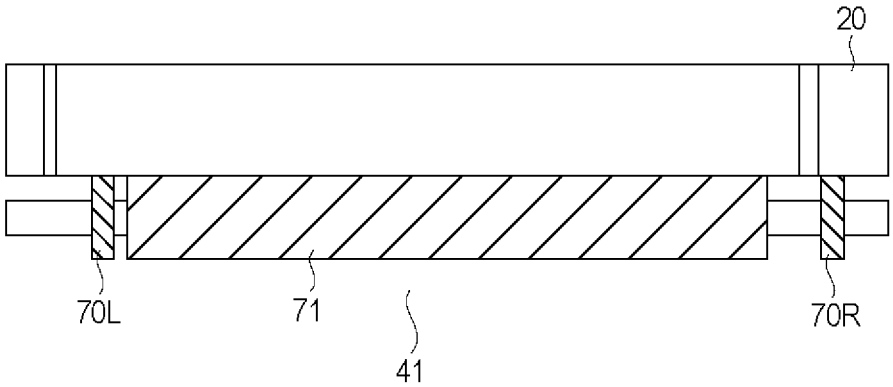
Figure 24:
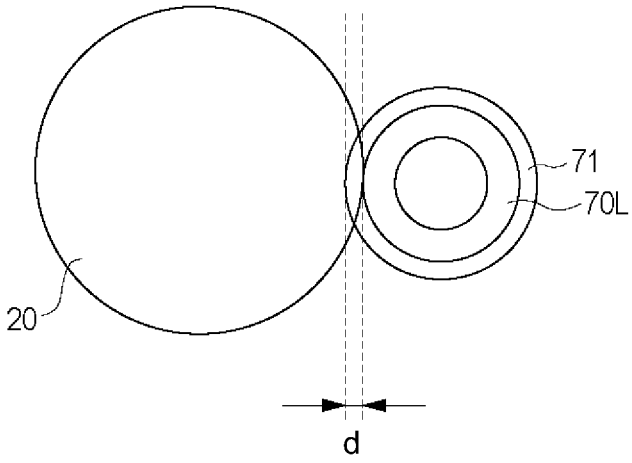

Parts (a) and (b) of FIG. 24 are schematic views showing contact between a developing roller and a photosensitive drum in Embodiment 5.

Figure 25:
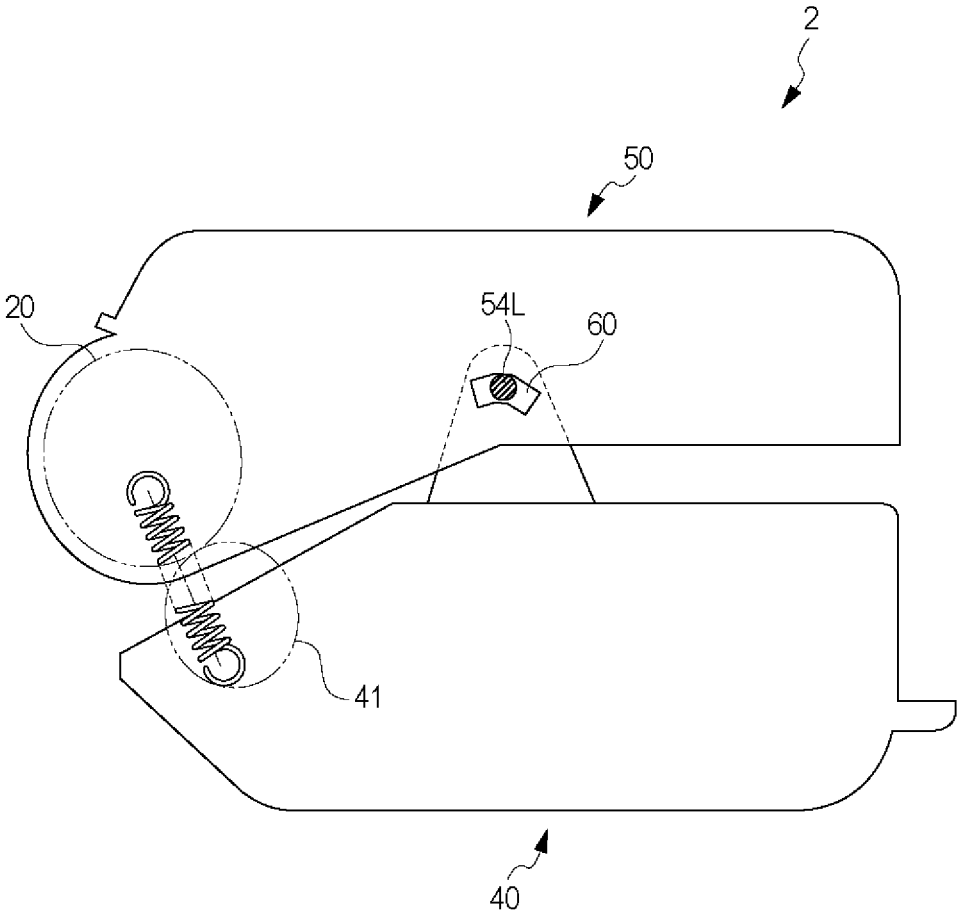

FIG. 25 is a schematic view showing a process cartridge in Embodiment 5.

Figure 26:
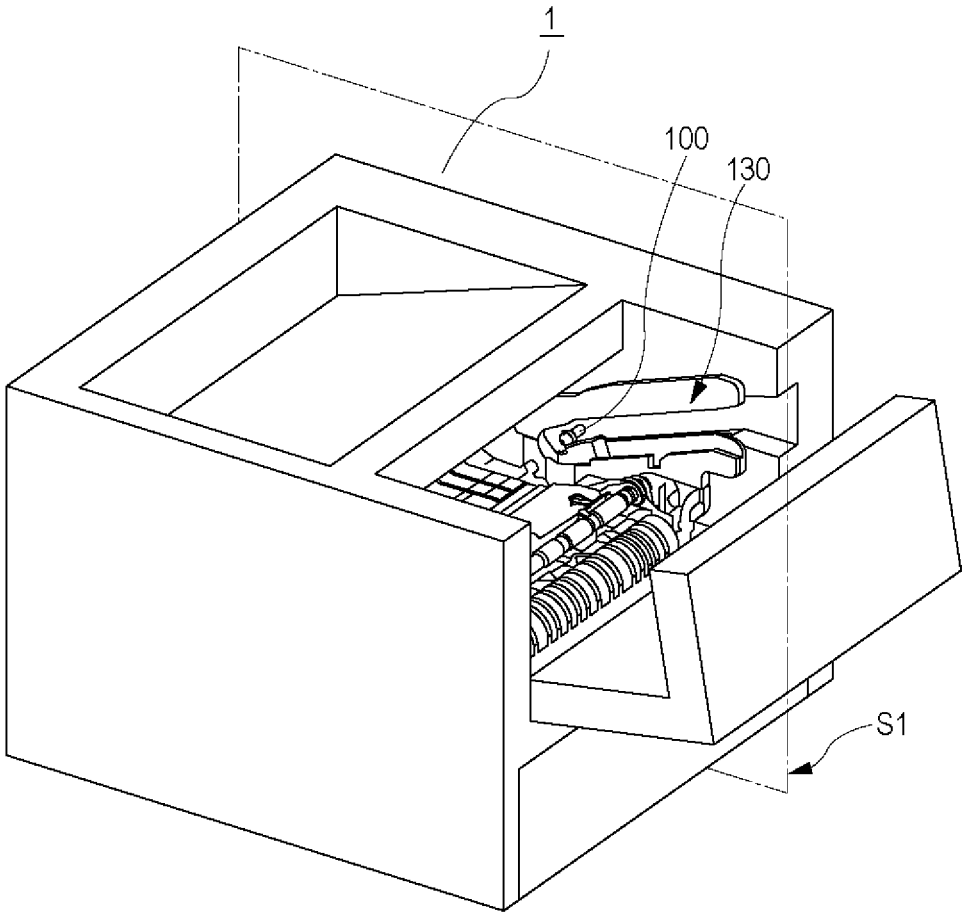

FIG. 26 is a perspective view for illustrating the main assembly of the image forming apparatus.

Figure 27:
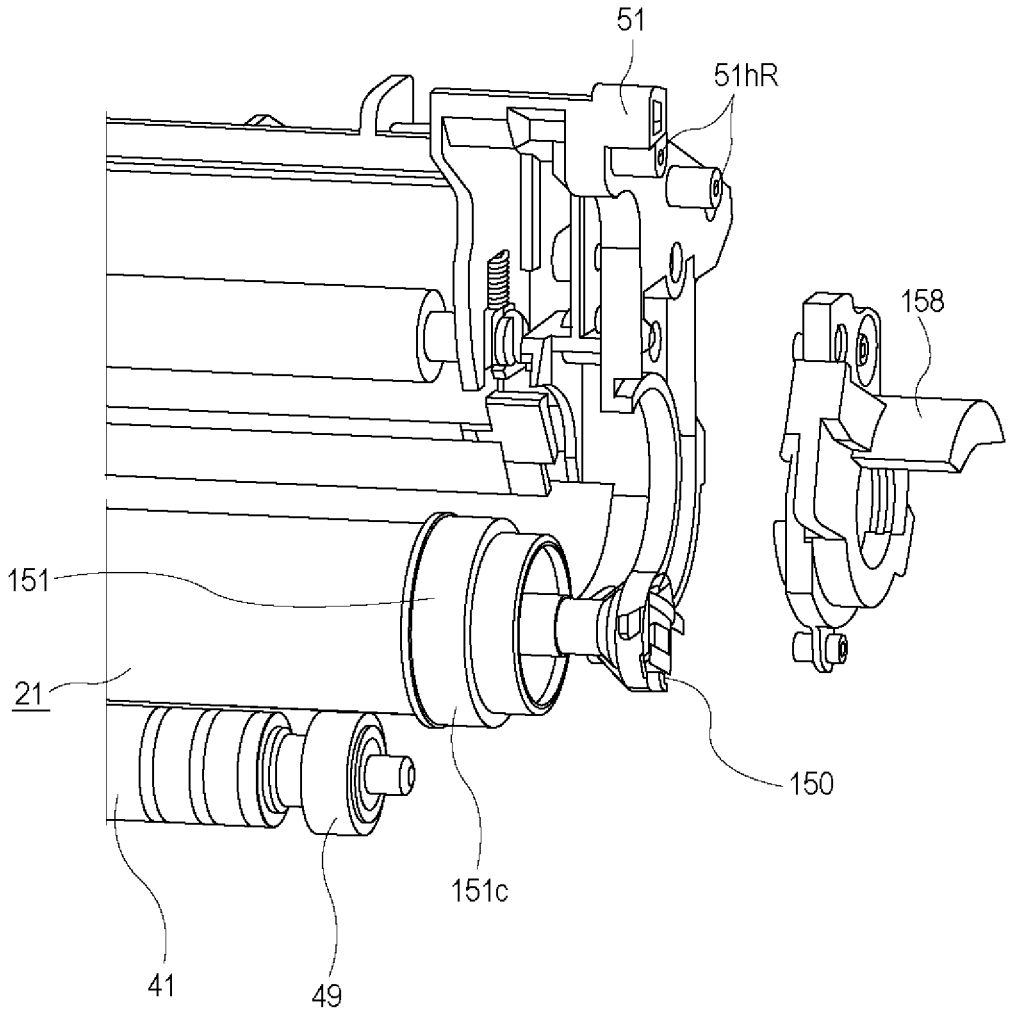
Figure 28:
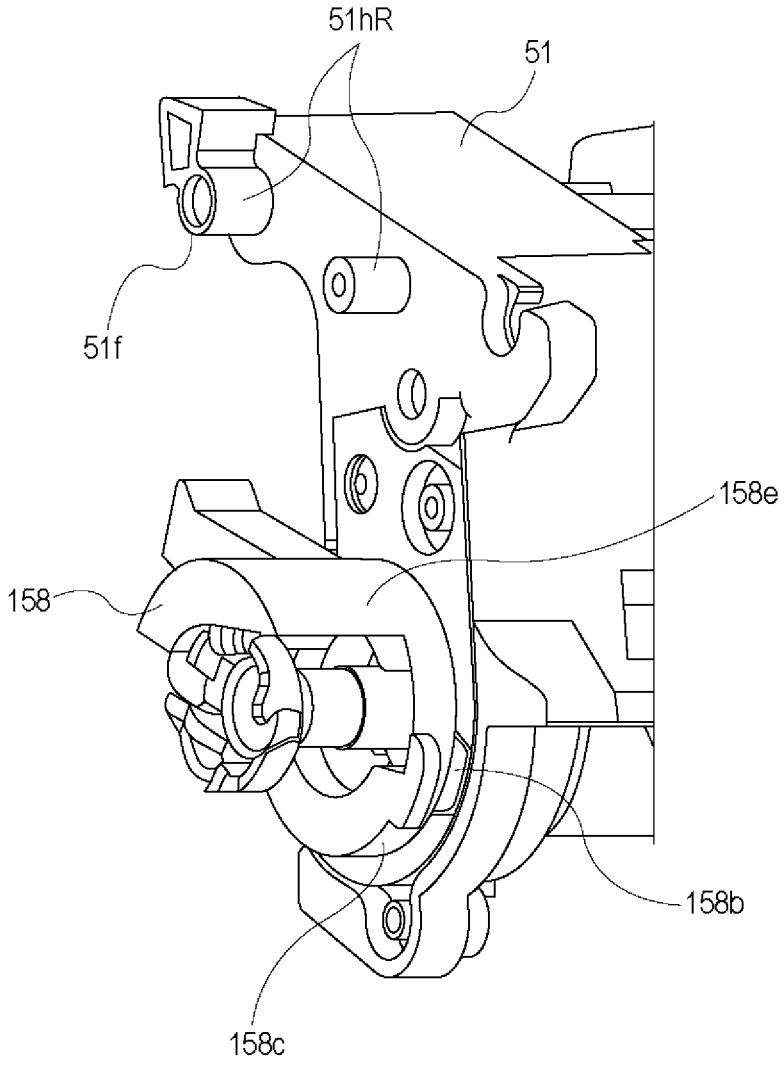

FIGS. 27 and 28 are perspective views for illustrating a drum unit supporting structure (at driving side).

Figure 29:
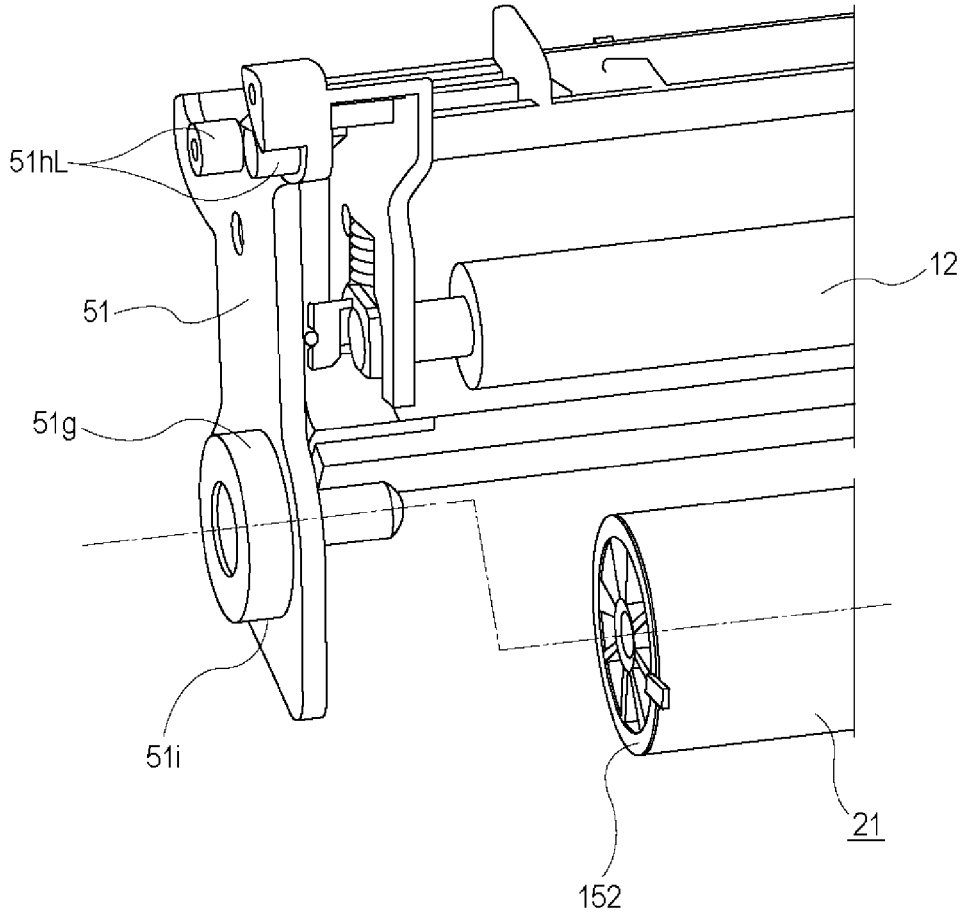

FIG. 29 is a perspective view for illustrating the drum unit supporting structure (at non-driving side).

Figure 30:
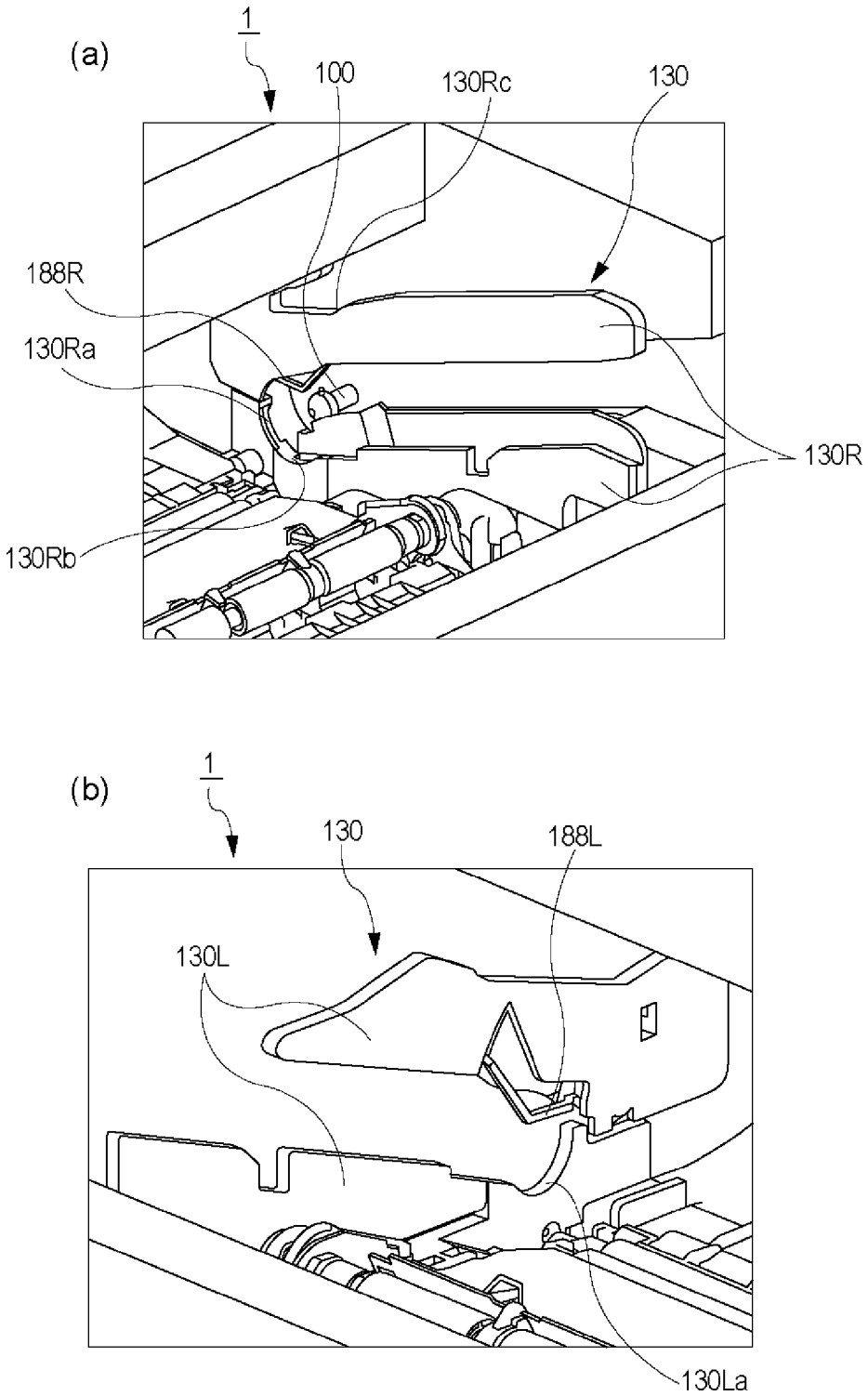

Parts (a) and (b) of FIG. 30 are perspective views showing a main assembly-side guide rail for permitting mounting and dismounting of the cartridge.

Figure 31:
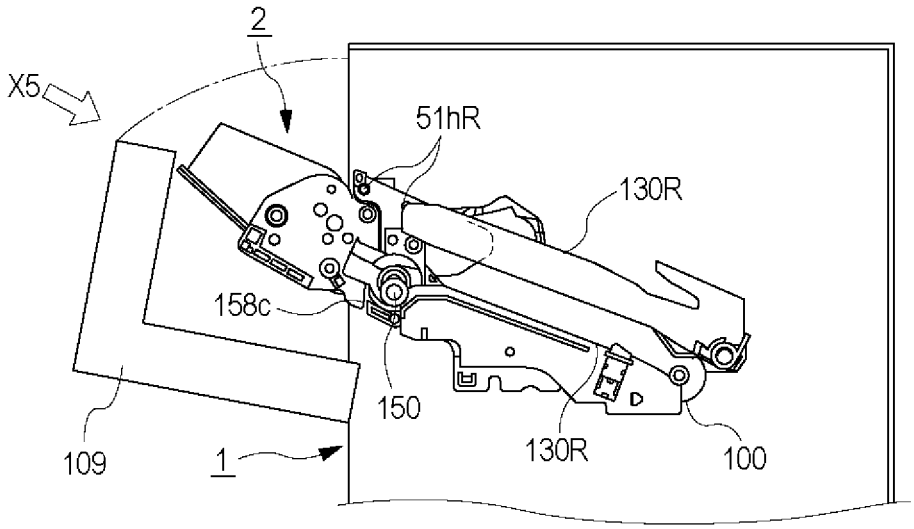
Figure 31:
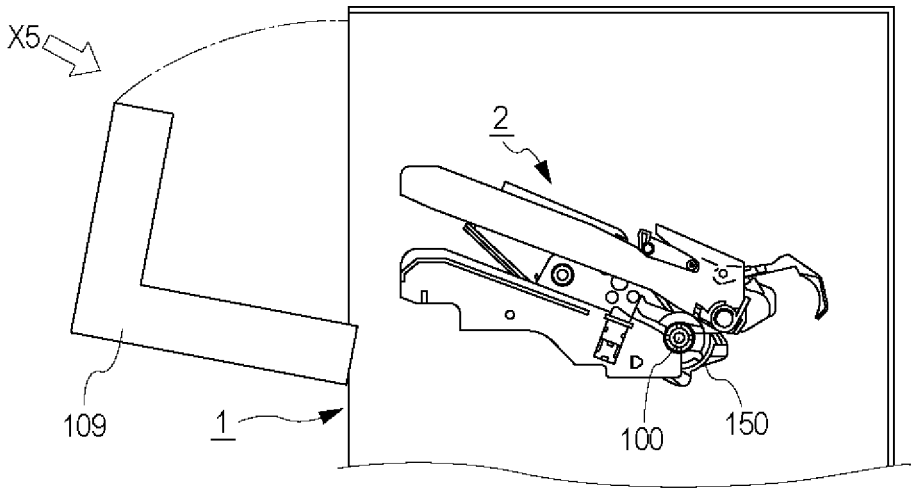

Parts (a) and (b) of FIG. 31 are schematic views for illustrating an inserting operation of the cartridge into the main assembly.

Figure 32:
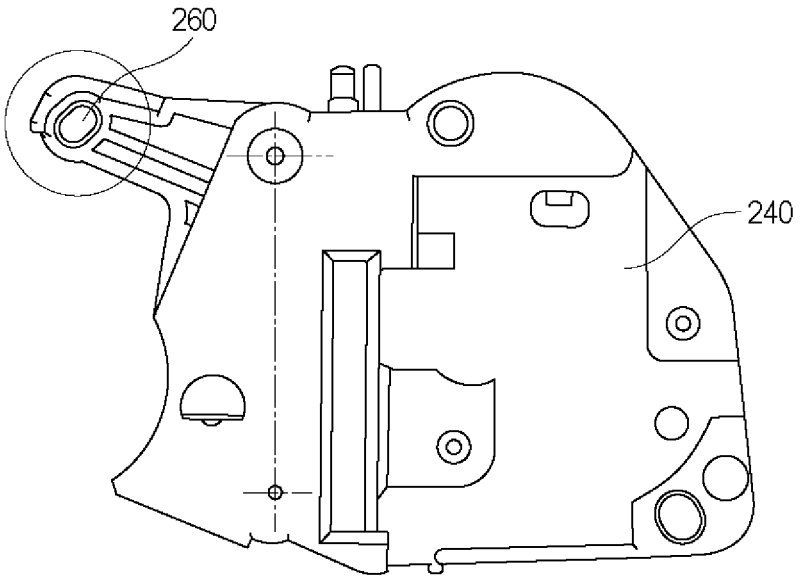
Figure 32:
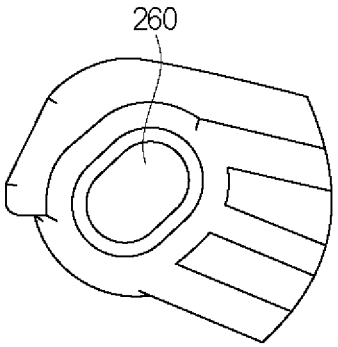

Parts (a) and (b) of FIG. 32 are side views of a developing unit in Comparative Embodiment.

Figure 33:
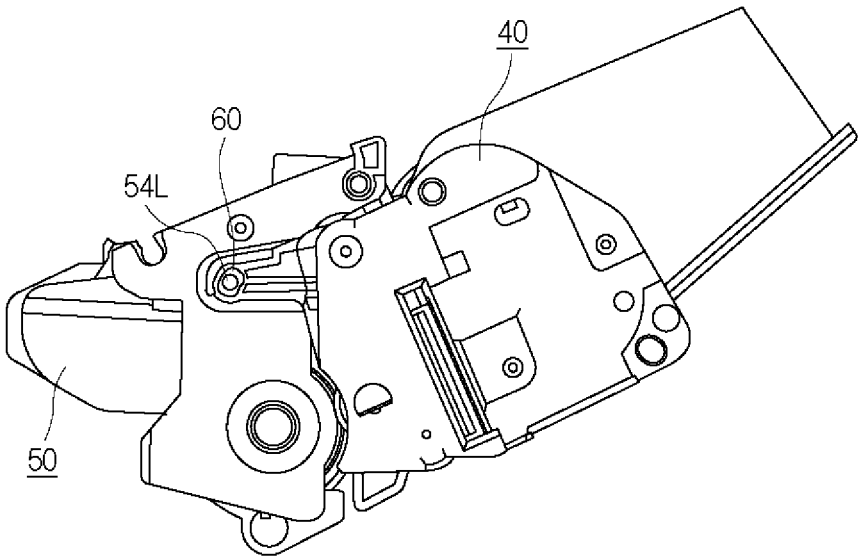
Figure 33:
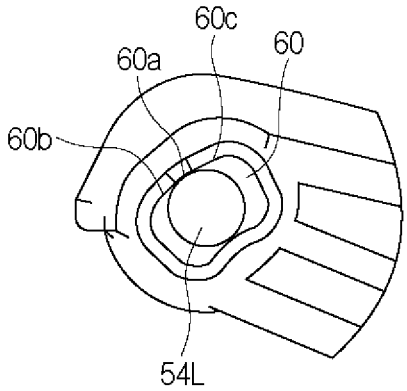

Parts (a) and (b) of FIG. 33 are side views of the cartridge in Embodiment 1.

Figure 34:
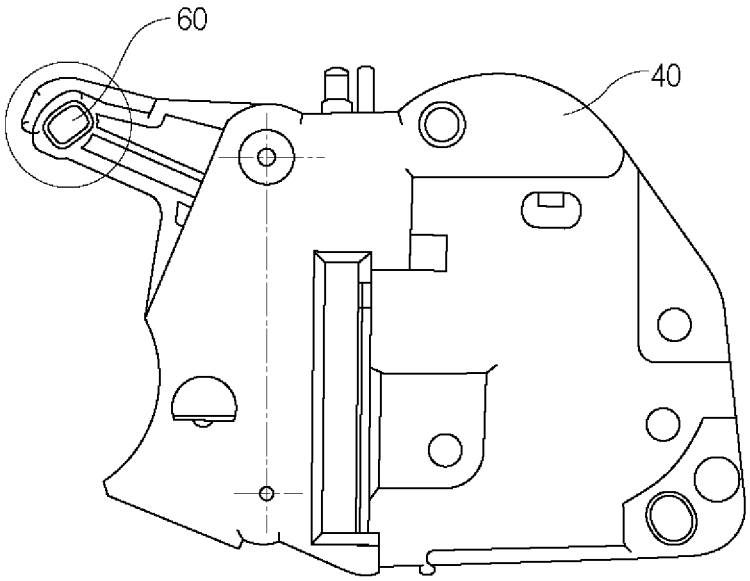
Figure 34:
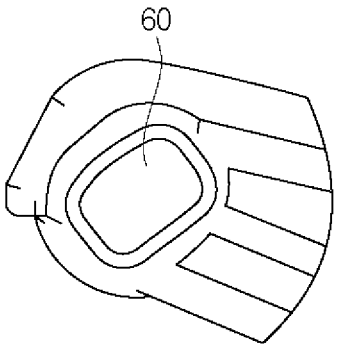

Parts (a) and (b) of FIG. 34 are side views of a developing unit in Embodiment 2.

DESCRIPTION OF THE PREFERRED EMBODIMENTS

Embodiment 1

The present invention will be described specifically by taking, as an example, a process cartridge of a non-contact development type to be mounted to an image forming apparatus main assembly using electrophotography.

(General Structure)

Figure 1:
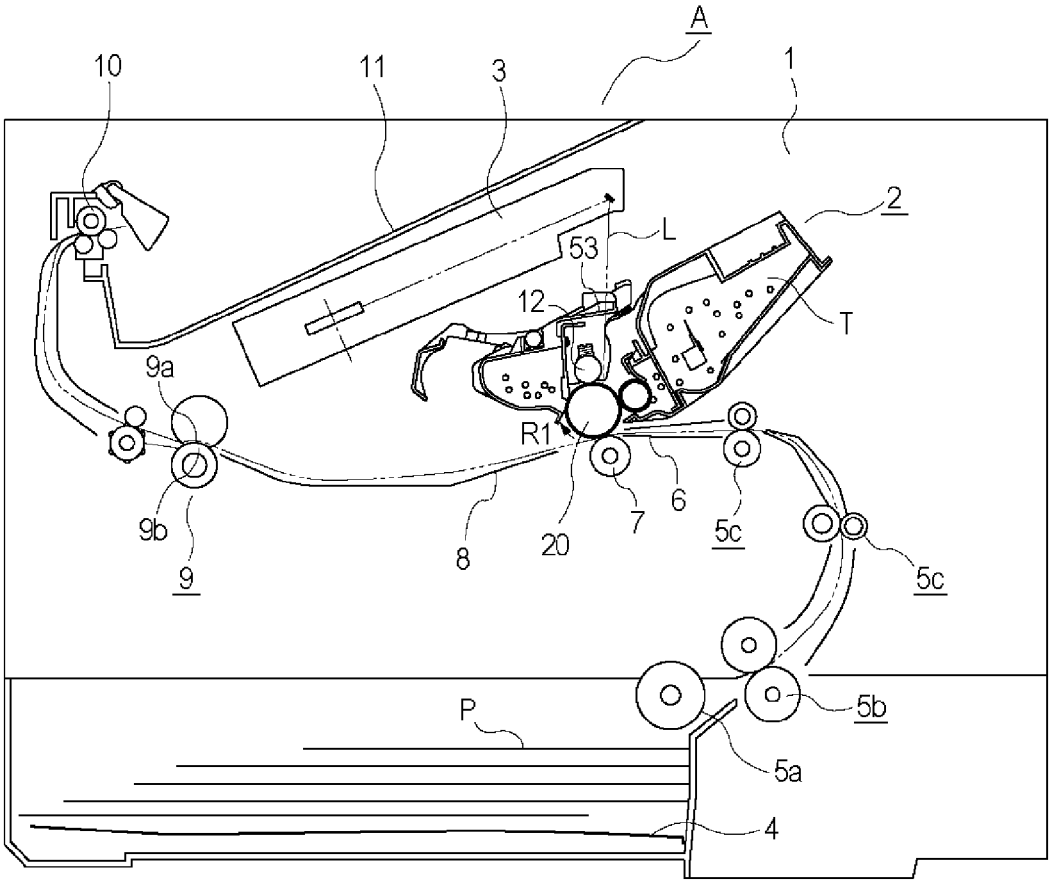
FIG. 1 is a schematic view of a main assembly and a process cartridge of an image forming apparatus in Embodiment 1.
Figure 2:
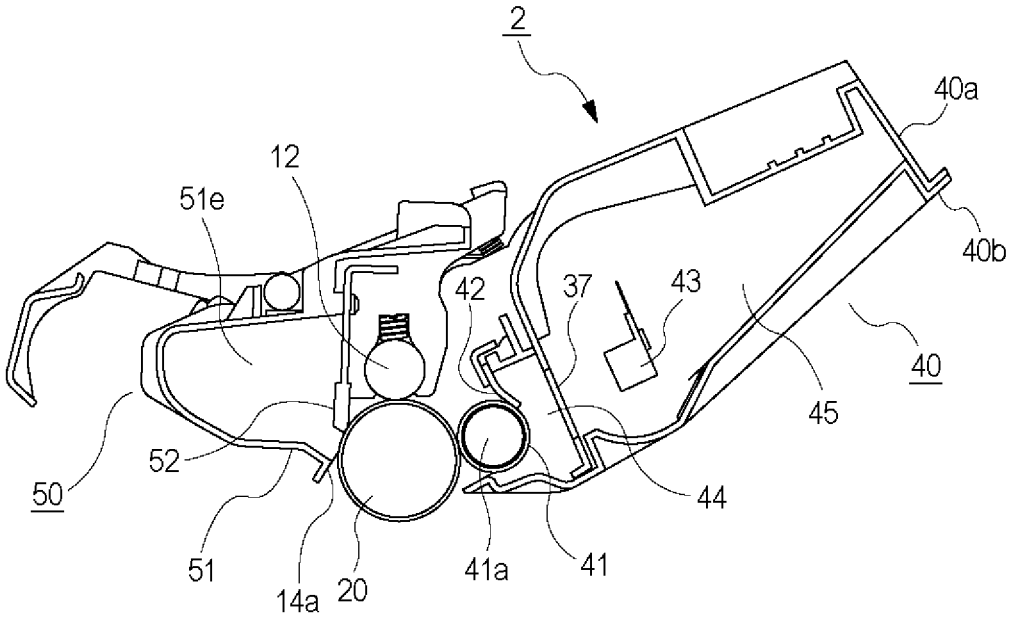
FIG. 2 is an enlarged schematic view of the process cartridge.

FIG. 1 is a schematic view of a main assembly 1 of an image forming apparatus A and a process cartridge in this embodiment. FIG. 2 is an enlarged schematic view of the cartridge 2. With reference to FIGS. 1 and 2, a general structure and an image forming process of the image forming apparatus A in this embodiment will be described below.

The image forming apparatus A is a laser beam printer, using electrophotographic, in which the cartridge 2 is detachably mountable to the main assembly 1.

When the cartridge 2 is mounted to the main assembly 1, an exposure device (laser scanner unit) 3 is disposed above the cartridge 2. Further, below the cartridge 2, a sheet tray 4 in which a recording material (sheet material) P to be subjected to image formation is accommodated. Further, in the main assembly 1, along a conveyance direction of the sheet material P, a pick-up roller 5*a*, a feeding roller 5*b*, a conveying roller pair 5*c*, a transfer guide 6, a transfer charging roller 7, a conveyance guide 8, a fixing device 9, a discharging roller pair 10, a discharge tray and the like are disposed.

(Image Forming Process)

Next, an image forming process will be described. On the basis of a print start signal, a drum-like electrophotographic photosensitive member (hereinafter referred to as a photosensitive drum) 20 which is an image bearing member is rotationally driven in an arrow R1 direction at a predetermined peripheral speed (process speed). To an outer peripheral surface of the photosensitive drum 20, a charging roller 12 to which a bias voltage is applied is contacted, so that the outer peripheral surface of the photosensitive drum 20 is uniformly charged by the charging roller 12.

From the exposure device 3, laser light L modulated corresponding to time-serial electric digital pixel signal of image information is outputted. The laser light L enters the cartridge 2 from an exposure window 53 at an upper surface of the cartridge 2. As a result, on the outer peripheral surface of the photosensitive drum 2, an electrostatic latent image corresponding to the image information is formed. The electrostatic latent image is developed with a developer T (hereinafter referred to as a toner) of a developing unit 40 to be visualized as a toner image.

The charging roller 12 is provided in contact with the photosensitive drum 20 and charges the photosensitive drum 20. This charging roller 12 is rotated by the rotation of the photosensitive drum 20. The developing unit 40 supplies the toner to a developing area of the photosensitive drum 20 to develop the latent image formed on the photosensitive drum 20.

In the developing unit 40, the toner T in a developer accommodating portion (hereinafter referred to as a toner chamber) 45 is fed to a developing portion (hereinafter referred to as a developing chamber) 44 by rotation of a stirring member 43. Then, a developing roller 41 as a developer carrying member containing a magnet roller (fixed magnet) 41*a* is rotated and a toner layer to which a triboelectric charge is provided by a developer regulating member (hereinafter referred to as a developing blade) 42 is formed on the surface of the developing roller 41.

Then, the toner is transferred onto the photosensitive drum 20 depending on the latent image, so that the toner image is formed to visualize the latent image. The developing blade 42 determines a toner amount at the peripheral surface of the developing roller 41 and imparts the triboelectric charge to the toner layer.

On the other hand, in synchronism with timing of output of the laser light L, the sheet material P accommodated at a lower portion of the main assembly 1 is fed from the sheet tray 4 by the pick-up roller 5*a*, the feeding roller 5*b* and the conveying roller pair 5*c*. The sheet material P is supplied with timing via the transfer guide 6 to a transfer position between the photosensitive drum 20 and the transfer charging roller 7. At the transfer position, the toner image is transferred successively from the photosensitive drum 20 onto the sheet material P.

The sheet material P is separated from the photosensitive drum 20 to the fixing device 9 along the conveyance guide 9. Then, the sheet material P passes through a nip between a fixing roller 9*a* and a pressing roller 9*b* which constitute the fixing device 9. In the nip, a press-heating fixing process is performed, so that the toner image is fixed on the sheet material P. The sheet material subjected to the toner image fixing process is conveyed to the discharging roller pair 10, thus being discharged on the discharge tray 11.

On the other hand, transfer residual toner is removed by a cleaning blade 52 from the outer peripheral surface of the photosensitive drum 20 after the transfer and then the photosensitive drum 20 is subjected again to the image formation starting from the charging. The residual toner removed from the photosensitive drum 20 is stored in a residual toner chamber 51*e* of a image bearing member unit 50. The charging roller 12, the developing roller 41, the cleaning blade 52 and the like are process means acting on the photosensitive drum 20.

(Image Bearing Member Unit)

Figure 3:
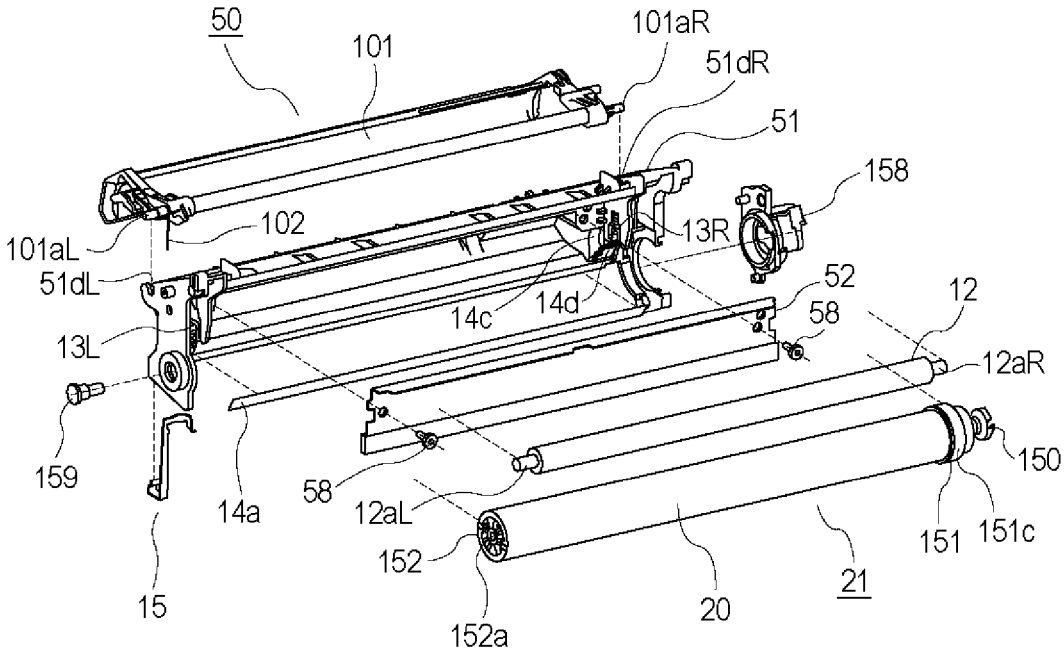
FIG. 3 is a perspective view for illustrating an image bearing member unit.

The image bearing member unit 50 will be described specifically with reference to FIGS. 2 and 3. FIG. 3 is a perspective view for illustrating the image bearing member unit 50.

As described above, the toner image developed by the developing unit 40 is transferred onto the sheet material P at a transfer portion. The toner remaining on the photosensitive drum 20 after the transfer is scraped by the cleaning blade 52 and is scooped by a receptor sheet 14*a* to be collected in the residual toner chamber 51*e*.

The residual toner chamber 51*e* is constituted by a drum frame 51 and a seal member 14*e* fixed on the drum frame 51 with a double-side tape or the like at a predetermined position.

The cleaning blade 52 is fixed with screws 58 at predetermined positions of the drum frame 51. Further, as a wiping member of a deposition matter such as the toner on the photosensitive drum 20, a seal member 14*d* is fixed on the drum frame 51 with a both-side tape.

An electrode 15 and charging roller bearing 13 (13L and 13R) are engaged into the drum frame 51, and shafts 12*a* (12*a*L and 12*a*R) are engaged into the charging roller bearings 13 (13L and 13R).

At one end portion of the photosensitive drum 20, a non-driving side drum flange 152 integrally including grounding contacts and the like is fixed. At the other end portion of the photosensitive drum 20, a drum flange 151 to which a coupling 150 which is a rotational force receiving member for receiving a rotational force from the main assembly 1 is attached is fixed. Thus, a photosensitive drum unit 21 is contacted.

The flange 151 of the drum unit 21 is rotatably engaged with the bearing 158 integrally attached to the drum frame 51. Further, a drum shaft 159 press-fitted into the drum frame 51 is rotatably engaged into a hole 152*a* provided in the non-driving side drum flange 152. As a result, the drum unit 21 is rotatably supported by the drum frame 51 at its both ends, so that the photosensitive drum 20 is rotatable relative to the drum frame 51.

At one end-side shaft 101*a*L of a protective member 101 for light-blocking and protecting the photosensitive drum 20, an urging spring 102 is mounted. The one end-side shaft 101*a*L and the other end-side shaft 101*a*R of the protective member 101 are mounted into substantially U-shaped bearing portions 51*d* (51*d*L and 51*d*R). Thus, an image bearing member unit 50 is completed.

In the following description, of both end sides of the process cartridge with respect to the axial direction of the photosensitive drum 20, a side where the coupling 150 is provided in the image bearing member unit 50 is referred to as a driving side and a side opposite from the driving side is referred to as a non-driving side.

(Developing Unit)

Figure 4:
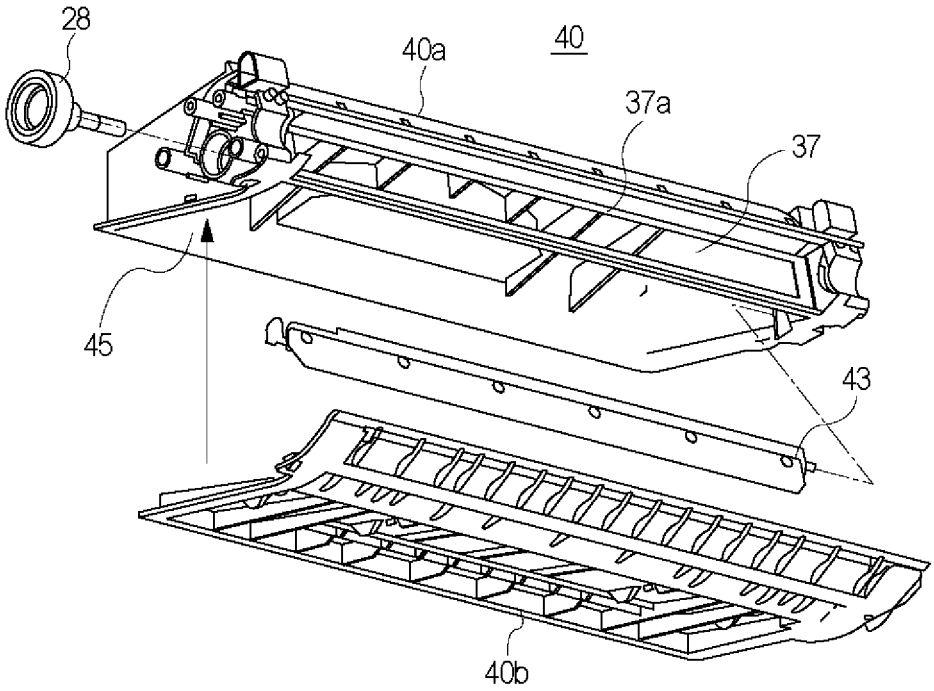
FIGS. 4 and 5 are perspective views for illustrating a developing unit.
Figure 5:
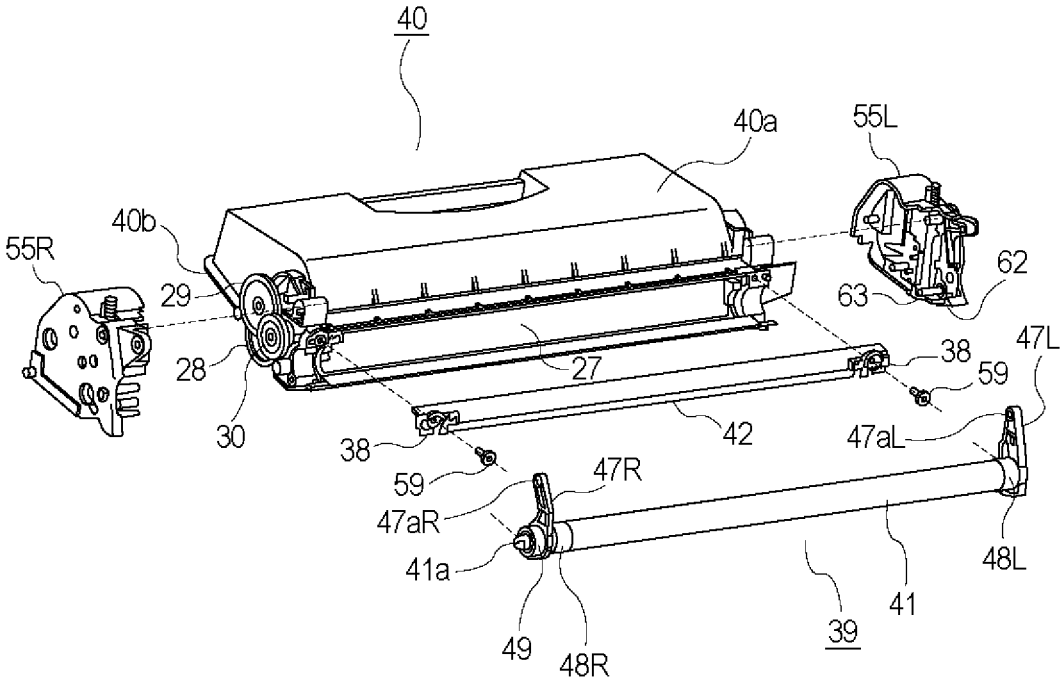

The developing unit 50 will be described with reference to FIGS. 4 and 5. FIG. 4 is a perspective view for illustrating a structure of the toner chamber 45. FIG. 5 is a perspective view for illustrating the developing unit 40.

As shown in FIG. 4, in the toner chamber 45, a stirring member 43 is disposed. The stirring member 43 is supported by a toner accommodating container 40*a* at the non-driving side and is supported by a helical gear 28 (hereinafter referred to as a stirring gear) attached to the toner accommodating container 40*a*. The stirring member 43 is rotated by rotation of the stirring gear 28.

Further, gears 30 and 29 (FIG. 5) are rotatably attached to the toner accommodating container 40*a* and are engaged with each other to rotate, so that a driving force is transmitted from the gear 30 to the stirring gear 28 via the gear 29.

The toner accommodating container 40*a* and a cover 40*b* are integrally bonded by ultrasonic welding. Around a supply opening 37, an opening edge 37*a* is formed with respect to a direction crossing an entering direction of the toner T. To the opening edge 37*a*, as shown in FIG. 5, a developer seal 28 (hereinafter referred to as a toner seal) is heat-fixed.

The developing blade 42 is fixed to the toner accommodating container 40*a* with screws 59 at its end portions together with cleaning members 38 for cleaning the end surfaces of the developing roller 41 in contact with the end surfaces of the developing roller 41. Then, a developing roller unit 39 is provided at a predetermined position. Incidentally, into the developing roller unit 39, a magnet roller 41*a* is inserted through an opening provided at a driving side of the developing roller 41 and at the opening, a developing roller flange 41*b* is press-fitted.

Further, spacing members 48 (48L, 48R) for keeping the gap between the photosensitive drum 20 surface and the developing roller 41 surface at a certain level and bearing members 47 (47L, 47R) are disposed at both end portions of the developing roller 41. Further, at the driving side, the developing roller 41 is provided with a developing roller gear 49 (second gear), which is engaged with a drum gear 151*c* (image gear) (FIG. 3) provided on a flange 151 of the image bearing member unit 50, for transmitting the rotational force to the developing roller 41. The developing roller gear 49 is engaged with the gear 30 shown in FIG. 5.

Then, a first side member 55L is attached to the toner accommodating container 40*a* at the non-driving side and a second side member 55M is attached to the toner accommodating container 40*a* at the driving side. Incidentally, the first side member 55L is provided with contacts 62 and 63 to be contacted to the main assembly.

Together with the fixing of the side members 55, positioning of the bearing members 47 (47L, 47R), disposed at both end portions of the developing roller unit 39, by the first and second side members 55L and 55R is effected. By these bearing members 47, the developing roller 41 is rotatably supported. Thus, the developing unit 40 is completed.

(Frame Structure of Process Cartridge)

Figure 6:
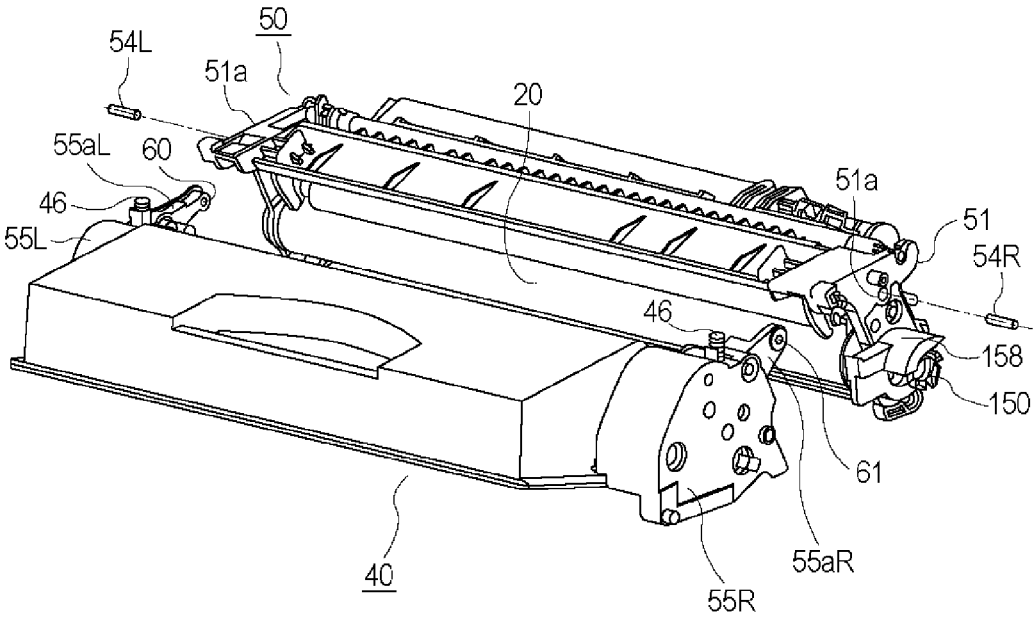
FIG. 6 is a perspective view for illustrating a frame structure of the process cartridge.

The frame structure of the process cartridge will be described with reference to FIGS. 2, 5, 6, 7 and 33. FIG. 6 is a perspective view for illustrating the frame structure of the cartridge 2. Parts (a) and (b) of FIG. 7 are schematic perspective views for illustrating details of a connecting portion between the image bearing member unit 50 and the developing unit 40. Particularly, (a) of FIG. 7 is a perspective view showing a state before connection between the image bearing member unit 50 and the developing unit 40. Further, (b) of FIG. 7 is a perspective view showing a state after the connection between the image bearing member unit 50 and the developing unit 40 (in which the image bearing member unit 50 is partly cut). Parts (a) and (b) of FIG. 33 are side views of the cartridge 2.

As shown in FIG. 2, the photosensitive drum 20, the charging roller 12 and the cleaning blade 52 are attached to the drum frame 51 to constitute the image bearing member unit 50. On the other hand, the developing unit 40 is, as shown in FIG. 5, constituted by the toner accommodating container 40*a*, the cover 40*b*, the side members 55 (55L, 55R), the developing roller 41 and the like. The toner accommodating container 40*a* and the cover 40*b* are integrally connected by a means such as welding or the like to form the developing device frame in which the toner chamber 45 containing the toner and the developing chamber 45 are provided. Further, the side members 55 (55L, 55R) are provided at longitudinal end portions of the developing unit 40 (with respect to the axial direction of the developing roller 41) and are connected to the toner accommodating container 40*a* by a means such as screws or welding.

Then, as shown in FIG. 6, the image bearing member unit 50 and the developing unit 40 are rotatably connected with each other by the connecting members 54 (54L, 54R) which are pins having a circular cross-sectional shape.

In this embodiment, as a material for the connecting member 54, SUS 303 is used. As the material for the frames of the image bearing member unit 40 and the developing unit 40, high-impact polystyrene (HIPS) is used. The connecting member 54 may also be formed of another metal or resin, and the image bearing member unit 50 and the developing unit 40 may also be formed of another resin.

At an end of a first arm portion 55*a*L formed on the side member 55L, an elongated hole-like opening 60 is provided. At an end of a second arm portion 55*a*R formed on the side member 55R, a circular hole 61 is provided.

When the developing unit 40 and the image bearing member unit 50 are connected, first, the arm portions 55*a* (55*a*L, 55*a*R) of the developing unit 40 are inserted into the drum frame 51 at predetermined positions. Here, as shown in (a) and (b) of FIG. 7, the drum frame 51 is provided with holes 51*a* (51*a*L, 51R) and holes 51*b* (51*b*L, 51*b*R) through which the connecting members 54 are passed.

At the driving side of the cartridge, the connecting member 54R is inserted into the circular hole 61 provided in the developing unit 50 and the holes 51*a*R and 51*b*R provided in the image bearing member unit 50, so that the developing unit 40 and the image bearing member unit 50 are connected.

First, as shown in (a) of FIG. 7, the connecting member 54R is inserted into the hole 51*a*R of the drum frame 51. The connecting member 54R and the hole 51*a*R establish an interference fit. Then, the connecting member 54R is inserted into the circular hole 61 of the developing unit 40.

Further, as shown in (b) of FIG. 7, the drum frame 51 is provided with the hole 51*b*R inside and coaxially with the hole 51*a*R with respect to the axial direction of the photosensitive drum 20. The connecting member 54 passing through the circular hole 61 is then press-fitted in the hole 51*b*R. The connecting member 54R and the hole 51*b*R establish an interference fit.

The connecting member 54R press-fitted in the holes 51*a*R and 51*b*R is placed in a state in which it is fixed to the image bearing member unit 50 at its end portions, so that the connecting member 54R is not rotated relative to the holes 51*a*R and 51*b*R and is not disconnected from the holes 51*a*R and 51*b*R.

The connecting member 54R is engaged with the circular hole 61 by a clearance fit. For this reason, the developing unit 40 is rotatably and movably connected to the image bearing member unit 50 with the connecting member 54R as an axis (shaft) (second axis (shaft)).

At the non-driving side of the process cartridge, the connecting member 54L is intended coaxially into the opening 60 provided in the developing unit 40 and the holes 51*a*L and 51*b*L provided in the image bearing member unit 50, so that the developing unit 40 and the image bearing member unit 50 are connected.

The connecting member 54L is press-fitted in the hole 51*a*L of the drum frame 51. The connecting member 54L and the hole 51*a*L establish an interference fit. The connecting member 54L is then inserted into the opening 60 of the developing unit 40.

The drum frame 51 is provided with the hole 51*b*L inside and coaxially with the hole 51*a*L with respect to the axial direction of the photosensitive drum 20. The connecting member 54L passes through the opening 60 and is press-fitted in the hole 51*b*L. The hole 51*b*L and the connecting member 54L also establish an interference fit. The connecting member 54L press-fitted in the holes 51*a*L and 51*b*L is placed in a state in which it is fixed to the image bearing member unit 50 at its end portions, so that the connecting member 54L is not rotated relative to the holes 51*a*L and 51*b*L and is not disconnected from the holes 51*a*L and 51*b*L.

The connecting member 54L contacts a part of an inner surface of the side member 55L at the boundary with the opening 60, thus connecting the image bearing member unit 50 and the developing unit 40.

In a state in which the image bearing member unit 50 and the developing unit 40 are connected by the connecting members 54, the developing unit 40 is urged against the image bearing member unit 50 by its own weight. As a result, the developing roller 41 provided in the developing unit 40 is pressed against the photosensitive drum 20 provided in the image bearing member unit 50.

Incidentally, in this embodiment, at base portions of the arm portions 55*a* (55*a*L, 55*a*R) of the developing unit 40, compression coil springs 46 are attached. The compression springs urge the arm portions 55*a* and the drum frame 51 by an elastic force thereof, so that the developing unit 40 is urged against the image bearing member unit 50 and thus the developing roller 41 is urged against the photosensitive drum 20 with reliability.

At the end portions of the developing roller 41, the spacing members 48 (48L, 48R) (FIG. 5) are attached, so that the developing roller 41 held with a pressure gap from the photosensitive drum 20. The spacing members 48 are contacted to the photosensitive drum 20, so that the developing roller 41 is pressed against the photosensitive drum 20. Incidentally, in the following description, pressure of the developing roller 41 exerted on the photosensitive drum 20 is also referred to as "DPR".

Further, the opening 50 engaged with the connecting member 54L at the non-driving side of the cartridge has an elongated hole-shape such that both ends of the opening 60 are bent relative to a central portion. Part (a) of FIG. 33 is a schematic view showing a whole side surface of the cartridge 2 and (b) of FIG. 33 is an enlarged view of the opening 60.

In this case, the connecting member 54L can change its engaging position within the elongated hole-like opening 60. For this reason, at the non-driving side (one end side), the developing unit 40 is rotatable relative to the image bearing member unit 50 with the connecting member 54L as an axis (shaft) (first axis (shaft)) and is connected slidably and movably relative to the image bearing member unit 50. This is because even in the case where positions of the connecting members 54L and 54R are deviated from reference dimensions (positions) by component tolerance, the engaging position between the opening 60 and the connecting member 54L is changed to permit absorption of the deviation.

Incidentally, the reason why the end portions of the opening 60 are bent relative to the central portion will be described later.

On the other hand, at the driving side of the cartridge 2, as described above, the connecting member 54R is engaged with the circular hole 61, not the elongated hole-like opening, so that the developing unit 40 and the image bearing member unit 50 are connected. At the driving side, the developing unit 40 cannot be slid and moved relative to the image bearing member unit 50. This is because the drum gear 151*c* and the developing roller gear 49 are provided and therefore an amount of engagement between these gears is prevented from varying.

Further, at the driving side of the cartridge 2, during the image formation (during the drive of the cartridge 2), engaging pressure is generated with respect to a pressure angle direction between the drum gear 151*c* and the developing roller gear 49. The engaging pressure generates rotation movement about the connecting member 54R in the developing unit 40, thus influencing on the D pressure of the developing roller 40 exerted on the photosensitive drum 20 at the driving side. For that reason, in this embodiment, when the cartridge 2 is viewed in the axial direction of the photosensitive drum 20, the circular hole 61 in which the connecting member 54R is engaged is provided at the same side as a side where the center of the photosensitive drum 20 is located with respect to a rectilinear line extending in the pressure angle direction.

By providing the circular hole 61 in such a manner, the rotation moment generated in the developing unit 40 by the engaging pressure acts so as to enhance the D pressure. That is, by the engaging pressure, it is possible to suppress that the developing roller 41 is separated (spaced) from the photosensitive drum 20.

Incidentally, when the circular hole 61 is provided at the above position, the D pressure at the driving side of the cartridge 2 is larger than that at the non-driving side of the cartridge 2 in some cases. For that reason, of the compression coil springs 46 provided at the longitudinal end portions of the developing unit 40, it is desirable that an urging force of the compression coil spring 46 provided at the non-driving side is made larger than that provided at the driving side. In some cases, the compression coil spring 46 is provided only at the non-driving side.

(Structure of Process Cartridge Mounting Portion)

FIG. 26 is a perspective view of the main assembly 1 when a cartridge door (main assembly cover, openable door) 109 is opened to expose the inside of the main assembly 1. The cartridge 2 is not mounted. With reference to FIG. 26, a rotational force transmitting method to the cartridge 2 will be described.

As shown in FIG. 26, the main assembly 1 is provided with guide rails 130 as a mounting means for mounting and dismounting the cartridge 2, and the cartridge is to be mounted in the main assembly 1 along the guide rails 130 (130L, 130R). At this time, a driving shaft 100 of the main assembly 100 and a coupling 150 (FIG. 6) as a rotational force receiving member provided to the cartridge 2 are connected in interrelation with a mounting operation of the cartridge 2. The driving state 100 is connected with an unshown drive transmitting means such as a gear train and an unshown motor which are provided to the main assembly 100. When the driving shaft 100 is driven by the motor, the photosensitive drum 20 receives the driving force from the main assembly 1 through the coupling 150, thus being rotated.

As shown in FIGS. 27 and 28, at the driving side end portion of the image bearing member unit 50 of the cartridge 2, a cartridge guide 51*h*R protruded from the drum frame 51 toward the outside is provided. Further, as shown in FIG. 29, at the non-driving side end portion of the image bearing member unit 50, a cartridge guide 51*h*L is provided.

When the cartridge 2 is mounted to and dismounted from the main assembly 1, the cartridge guide 51*h*R and a cylindrical portion 158*c* of the bearing member 158 shown in FIG. 28 are guided along the guide rail 130R shown in (a) of FIG. 30. Further, the cartridge guide 51*h*L and a cylindrical portion 51*i* of the drum frame 51 shown in FIG. 29 are guided along the guide rail 130L shown in (b) of FIG. 30. Thus, the cartridge 2 is mounted to and dismounted from the main assembly 1 by being moved in a direction substantially perpendicular to the axial direction of the driving shaft 100.

Next, with reference to FIG. 31, the mounting operation of the cartridge 2 into the main assembly 1 will be described.

Parts (a) and (b) of FIG. 31 are schematic views of the cartridge 2 and the main assembly 1 taken along a surface S1 shown in FIG. 26. As shown in FIG. 31, the cartridge door 109 is opened by a user. Then, at the driving side, the cartridge guide 51*h*R and the cylindrical portion 158*c* are guided along the guide rail 130R, so that the process cartridge is inserted into the mounting portion of the main assembly 1. At the non-driving side, the cartridge guide 51*h*L and the cylindrical portion 51*i* are guided along the guide rail 130L ((a) of FIG. 31). When the cartridge 2 is inserted into an arrow X5 direction, the driving shaft 100 and the coupling 150 of the cartridge 2 are engaged, so that the cartridge 2 is mounted at the pressure position (mounting portion) ((b) of FIG. 31). At this time, from urging springs 188R and 188L shown in (a) and (b) of FIG. 30, a receiving portion 148*e* of the bearing member 158 (FIG. 28) and a receiving portion 51*g* of the drum frame 51 (FIG. 29) receive the urging force and are fixed.

Further, as shown in (a) of FIG. 30, the guide rail 130R of the main assembly 1 includes a rib 130Ra as a first main assembly-side positioning portion and a recessed portion 130Rb as a second main assembly-side positioning portion. When the cartridge 2 is mounted in the main assembly 1, a groove 158*b* and the cylindrical portion 148*c* of the cartridge 2 are engaged with the rib 130Ra and the recessed portion 130Rb of the main assembly 1, respectively.

Further, as shown in (b) of FIG. 30, the guide rail 130L of the main assembly 1 includes a recessed portion 130La as a third main assembly-side positioning portion. When the cartridge 2 is mounted in the main assembly 1, the cylindrical portion 51*i* of the cartridge 2 is engaged with the recessed portion 130La of the main assembly 1.

Further, when the coupling 150 of the cartridge 2 receives the driving force from the driving shaft 100, the drum frame 51 rotates in the rotational direction (in the counterclockwise direction in FIG. 28). As a result, a receiving surface 51*f* of the cylindrical portion of the drum frame 51 is engaged with a receiving portion 130Rc of the guide rail 130R.

By the above-described constitution, the positioning of the cartridge 2 relative to the main assembly 1 is made.

(Relationship Between Cartridge and D Pressure in Comparative Embodiment)

At the end portions of the cartridge 2, the developing unit 40 and the image bearing member unit 50 are rotatably connected and therefore the developing roller 41 of the developing unit 40 is urged toward the photosensitive drum 20 via the spacing members 48L and 48R.

Here, as Comparative Embodiment for Embodiment 1, by taking, as an example, a cartridge 202 to which the present invention is not applied, the pressure (D pressure) of the developing roller exerted on the photosensitive drum will be described with reference to FIGS. 8 and 9. The D pressure is, as shown in FIG. 8, generated by contact of a photosensitive drum 220 with spacing members 248L and 248R provided at the end portions of a developing roller 241. For that reason, the D pressure is present at each of one end side (non-driving side) and the other end side (driving side) with respect to the axial direction of the photosensitive drum 220.

A developing unit 240 is provided rotatably relative to an image bearing member unit 250, so that a developing roller 241 is contacted to the photosensitive drum 220 in a substantially parallel state, thus being stably urged against the photosensitive drum 200. Values of the D pressure are balanced between the non-driving side and the driving side.

However, dimensional tolerance of parts (components) used in the cartridge 202 and deformation of the cartridge 202 influence on the connected between the developing unit 240 and the image bearing member unit 250, so that the D pressure breaks the balance between the non-driving side and the driving side in some cases.

Hereinbelow, a fluctuation in D pressure will be described by taking, as an example, the case where the position of a connecting member 254L for connecting the developing unit 240 with the image bearing member unit 250 is deviated from the position of a connecting member 254R by the tolerance or the like of the components used in the cartridge. Incidentally, the connecting member 254L is provided at the non-driving side and the connecting member 254R is provided at the driving side. Further, in (a) of FIG. 8, Z represents a direction connecting the photosensitive drum center and the developing roller center.

When the connecting members 254L and 254R are viewed from the axial direction of the photosensitive drum 220, on the basis of the position of the connecting member 254R ((a) of FIG. 8) as a reference position, the case where the position of the connecting member 254L is deviated in the horizontal direction is considered ((b) and (c) of FIG. 8).

[Case where there is No Positional Deviation of Connecting Member (not Shown)]

In the case where the positions of the connecting members 254L and 254R overlap with each other when viewed from the axial direction of the photosensitive drum 220, the connecting member 254L is engaged at the substantially central portion of an opening 260. In this case, the developing roller 241 is contacted to the photosensitive drum 220 in a state in which the axis of the developing roller 241 is substantially parallel to the axis of the photosensitive drum 220, and the spacing members 248L and 248R provided at the end portions of the developing roller 241 are contacted to the photosensitive drum 220 at the substantially same pressure.

The D pressure in this state is represented by a point (a) in a graph of FIG. 9. FIG. 9 is the graph for illustrating a change in D pressure in Comparative Embodiment, wherein an abscissa represents an amount of positional deviation of the connecting member 254L from the position of the connecting member 254R as seen in the axial direction of the photosensitive drum 220. That is, with respect to the horizontal direction of FIG. 8, the position of the connecting member 254L when the position of the connecting member 254R is taken as the reference position is shown. Further, an ordinate represents an amount of change in D pressure. The D pressure when the connecting member 254L is located at the reference position is taken as a reference value, and the change amount of the D pressure is shown. At the point (a) in FIG. 9, the change amount of the D pressure is 0 (zero) both at one end side (non-driving side "NDS") and the other end side (driving side "DS").

[Case where Connecting Member Positional Deviation=x1 (within Tolerable Range)]

Next, the case where the center of the connecting member 254L is deviated from the center of the connecting member 254R toward horizontal one end side (leftward direction) will be described.

In (b) of FIG. 8, the position of the connecting member 254L is deviated from the (reference) position of the connecting member 254R toward the horizontal one end side (leftward direction) by a distance (deviation) x1.

By occurrence of the deviation x1, as shown in (b) of FIG. 8, the engaging position between the connecting member 254L and the opening 260 having one end 260*d* and the other end 260*e* is moved toward the other end 260*e*. However, at this time, the connecting member 254L and the other end 260*e* of the opening 260*e* are not contacted to each other and a clearance remains. Therefore, the deviation x1 between the connecting members 254L and 254R can be absorbed by the change in engaging position between the connecting member 254L and the opening 260. For that reason, the end portions of the developing roller 241 are stably urged against the photosensitive drum 220.

That is, the positional deviation of the connecting member 254L from the connecting members 254R is absorbed by the opening 260, so that the pressure (D pressure) of the developing roller 241 exerted on the photosensitive drum is substantially the same value at the end portions of the developing roller 241 (section (b) in FIG. 9).

[Case where Connecting Member Positional Deviation=x2 (outside Tolerable Range)]

Part (c) of FIG. 8 shows a state in which the position of the connecting member 254L is deviated from the position of the connecting member 254R in the horizontal direction by a distance x2 which is larger than the distance x1. The connecting member 254L is moved by a distance which is not less than the clearance (gap) caused between itself and the opening 260 and thus interferes with the other end 260*e*. Therefore, the opening 260 of the developing unit 240 is moved toward the image bearing member unit 250 in a state in which the other end 260*e* receives a force from the connecting member 254L. As a result, at the non-driving side (one end side) of the cartridge 202 where the opening 260 is provided, the developing roller 241 receives a force in a direction in which the pressure 241 approaches the photosensitive drum 220, so that the D pressure is increased. Further, the sum total of the D pressure at the non-driving side and the D pressure at the driving side is constant. For that reason, the D pressure is decreased at the driving side (the other end side) correspondingly to the increase in D pressure at the non-driving side (range (c) in FIG. 9).

On the other hand, the case where the center of the connecting member 254L is deviated from the center of the connecting member 254R in a horizontal (+) side (rightward direction) by the distance (deviation) x2 will be described. At this time, such a positional relationship that the connecting member 254L is pressed against one end 260*d* of the opening 250 is formed. The opening 260 provided in the developing unit 240 is moved apart from the image bearing member unit 250 in a state in which a force is applied from the connecting member 254L to one end 260*d*. That is, the developing roller 241 of the developing unit 240 receives, at the non-driving side, the force in a direction in which the developing roller 241 is moved apart from the photosensitive drum 220. As a result, the D pressure is decreased at the non-driving side. Further, correspondingly to the decrease in D pressure at the non-driving side, the D pressure is increased at the driving side (one end side) (range (d) of FIG. 9).

That is, when the position of the connecting member 254L is deviated from the position of the connecting member 254R to the extent that the connecting member 254L contacts one end 260*d* of the opening 260, the D pressure is changed abruptly.

Therefore, in order to decrease the abrupt change in D pressure, even when the position of the connecting member 254L is deviated from the position of the connecting member 254R, it is preferable that the connecting member 254L does not apply the force to the ends of the opening 260. That is, a constitution in which the connecting member 254L always creates a clearance between itself and one end 260*d* and a clearance between itself and the other end 260*e* may preferably be employed.

Here, according to study by the present inventors, in order to create the clearance between the connecting member 254L and one end 260*d* and the clearance between the connecting member 254L and the other end 260*e*, setting of a slope of the opening 260 with respect to the horizontal direction within a predetermined range is effective. With reference to FIGS. 10 to 13, a proper slope of the opening 260 in the cartridge 202 will be described. Parts (a) and (b) of FIG. 10 are schematic schematic views for illustrating a relationship among forces exerted on the developing unit in Comparative Embodiment. FIG. 11 is a graph showing a relationship between an angle of the opening 260 and the force applied to the developing unit 240. FIG. 12 is a schematic view showing the forces applied to the developing unit 240. FIG. 13 is a graph showing a relationship between a positional deviation of the connecting member and an amount of change in D pressure.

In order to maintain a state in which the connecting member 254L is engaged in the opening 260 while creating the clearances thereof with both ends of the opening 260, there is a need to balance the forces applied to the developing unit 240 when the connecting member 254L is engaged in the opening 260. If the forces applied to the developing unit 240 are not balanced, by a resultant force applied to the developing unit 240, the developing unit 240 is slid and moved along an opening 260 forming direction. As a result, the engaging position between the connecting member 254L and the opening 260 is moved, so that the connecting member 254L is contacted to one end 260*d* or the other end 260*e* of the opening 260.

A condition for balancing the forces acting on the developing unit 240 at the non-driving side (one end side) when the cartridge 202 is mounted in the main assembly will be described with reference to (a) and (b) of FIG. 10 which are the schematic schematic views (free body views) of the cartridge 202.

To the developing unit 240, forces Fi (i=1 to 7) are applied as shown in (a) and (b) of FIG. 10. F1 is a counteracting force received, as a reaction force, by the developing roller 241 when the developing roller 241 presses the photosensitive drum 220. Therefore, F1 is equal in amount (value) to the D pressure. F2 is the self weight of the developing unit 240. F3 is a force of the compression coil spring 246 which contacts the drum frame 251 and urges the developing unit 240 downward. F4 is a contact pressure received by a contact portion 262 from the main assembly 1. F5 is a contact pressure received by a contact portion 263 from the main assembly 1. F6 is normal reaction (normal component of reaction) received by the opening 260 from the connecting member 254L. F7 is a frictional force received by the opening 260 from the connecting member 254L.

Further, a distance between each force Fi and the connecting member 254L is Li and an angle formed between each Fi and the horizontal surface is θi.

In this case, the condition for balancing the forces applied to the developing unit 240 is required to satisfy the following formulas (1) to (4).

$$-F1\times L1+F2\times L2+F3\times L3-F4\times L4-F5\times L5+F7\times L7=0 \quad (1)$$

(Formula (1): balance of moment about connecting member 254L)

$$\sum_{i=1}^{7} Fi\cdot\cos\theta_i = 0 \quad (2)$$

(Formula (2): balance of forces with respect to X direction)

$$\sum_{i=1}^{7} Fi \cdot \sin\theta_i = 0 \tag{3}$$

(Formula (3): balance of forces with respect to Y direction)

$$-\mu F6 \leq F7 \leq \mu F6 \tag{4}$$

(Formula (4): condition in which frictional force F1 is not more than maximum static frictional force)

In the formula (4), μ represents a coefficient of static force.

Further, (+) direction of the moment is the clockwise direction. The horizontal direction ("H" is X direction, and the vertical direction ("V") is Y direction ((a) of FIG. 10).

A force required to balance the forces applied to the developing unit 240 is obtained by solving the formulas (1) to (3) simultaneously. However, F3 to F5 of the forces Fi (i=1 to 7), L1 to L7 and θ1 to θ5 are design regulation (control) values. Further, θ6=θ7+90° (degrees). When these values are substituted into the formulas (1) to (3), the forces F1, F6 and F7 which are unshown values can be obtained as a function of θ7. However, an absolute value of the frictional force F7 can only be a value which is below the maximum static frictional force generated between the opening 260 and the connecting member 254L. The maximum static frictional force generated between the opening 260 and the connecting member 254L is, by using the coefficient of static friction μ and the normal reaction F6, obtained as μF6 and −μF6. Therefore, in order to actually balance the forces applied to the developing unit 240, the forces F6 and F7 obtained from the formulas (1) to (3) are required to satisfy the formula (4). Here, the graph in which the abscissa represents a slope θ7 of the opening and the ordinate represents the normal reaction F6 and the frictional force F7, which are obtained from the formulas (1) to (3), and the maximum static frictional forces μF6 and −μF6 is shown in FIG. 11.

From FIG. 11, the formula (4) is satisfied in the case where the slope θ7, θmax and θmin satisfy the following formula (5).

$$\theta\min \leq \theta 7 \leq \theta\max \tag{5}$$

In FIG. 11 and the formula (5), θmax represents a value of θ7 when F7=μF6 is satisfied, and θmin represents a value of θ7 when F1=−μF6 is satisfied.

When the formula (5) is satisfied, the forces Fi (i=1 to 7) satisfying the formulas (1) to (4) are generated in the developing unit 240, so that the forces applied to the developing unit 400 are balanced. As a result, in a state in which the connecting member 254L is not contacted to the ends 260*d* and 250*e* of the opening 260, the connecting member 254L is engaged in the opening 260.

Further, in the case where the formula (5) is satisfied, particularly, the D pressure when θ7=θopt is satisfied is most stable. This is the case where the θopt is an angle when F7=0 is satisfied and the forces applied to the developing unit 240 are balanced even when the frictional force does not act between the opening 260 and the connecting member 254L. The angle θopt will be described more specifically.

As shown in FIG. 12, the opening 260 is formed perpendicular to a force Fa, which is the resultant force of the forces F1 to F5, so as to generate the normal reaction F6 satisfying the following formula (6).

$$\vec{F6} = -\sum_{i=1}^{5} \vec{Fi} = -\vec{Fa} \tag{6}$$

The slope of the opening 2n60 when the formula (6) is satisfied provides the angle θopt. When the angle of the opening 260 is θopt, the forces applied to the developing unit 240 are balanced even when the frictional force F7 is applied between the opening 260 and the connecting member 254L. That is, the engagement between the connecting member 254L and the opening 260 does not generate a force for moving the connecting member 254L to one end 260*d* or the other end 260*e* of the opening 260, so that the D pressure can be further stabilized.

Here, a part of the developing unit 240 when the angle of the opening 260 is θopt is shown in (a) of FIG. 32 as a side view. Part (b) of FIG. 32 is an enlarged view of the opening 260 shown in (a) of FIG. 32. In this comparative embodiment, a longitudinal width of the opening 250 is 4.3 mm and a diameter in cross-section of the connecting member 254L engaged in the opening 260 is 3 mm.

The fluctuation of the D pressure in Comparative Embodiment is indicated by a thick line (a) in FIG. 13. In FIG. 13, the abscissa represents an amount (mm) of deviation of the position of the connecting member 254L from the position of the connecting member 254R, as seen from the axial direction of the photosensitive drum 220, in a direction from the center of the photosensitive drum 220 towards the center of the developing roller 241. That is, with respect to the direction from the center of the photosensitive drum 220 toward the center of the developing roller 241, the abscissa represents the position of the connecting member 254L when the position of the connecting member 254R is the reference position. Further, in the graph of FIG. 13, the ordinate represents the change amount (gf) of the D pressure. The D pressure when the position of the connecting member 254L is located at the reference position is zero from which the change amount (gf) is shown. Incidentally, in FIG. 13, only the D pressure at the non-driving side (one end side) of the cartridge is shown.

According to the thick line (a) in FIG. 13, in a range of a value of the abscissa from −0.3 to +0.4, the change in D pressure is small. When the positional deviation of the connecting member 254L with respect to the position of the connecting member 254R is within the above range, the connecting member 254L does not apply the force to the ends of the opening 260 and thus it is understood that the D pressure is not fluctuated.

(Problem in Comparative Embodiment)

When, e.g., the user mounts the cartridge 202 into the main assembly, the force is unintentionally applied to the developing unit 240 in some cases. When the force is externally applied to the developing unit 240, the opening 260 is moved relative to the connecting member 254L in some cases. In these cases, at the non-driving side (one end side), the developing unit 240 is moved relative to the image bearing member unit 250. At the non-driving side, when the developing unit 240 approaches the image bearing member unit 250, the developing roller 241 is strongly pressed against the photosensitive drum 220, so that the D pressure becomes large. On the other hand, at the non-driving side, when the developing unit 240 is moved apart from the image bearing member unit 250, a force for moving the developing roller 241 apart from the photosensitive drum 220 is applied, so that the D pressure becomes small.

Depending on the frictional force generated between the opening 260 and the connecting member 254L, the developing unit 240 is not returned to the original position but is left in the state in which the D pressure is largely fluctuated.

The fluctuation in D pressure in the case where the developing unit 240 is moved at the non-driving side by the external force will be described below with reference to FIGS. 13 and 14. Parts (a), (b) and (c) of FIG. 14 are schematic schematic views for illustrating the engaging position between the opening 260 and the connecting member 254L in Comparative Embodiment.

A state in which the connecting member 254L is deviated, due to the tolerance of the process cartridge, from the connecting member 254R by −0.2 mm in the direction from the center of the photosensitive drum 220 toward the center of the developing roller (i.e., the point of −0.2 on the abscissa of FIG. 13) is shown as an example. In this state, when the cartridge 202 is in a normal state, the connecting member 254L and the opening 260 are engaged in a state shown in (b) of FIG. 14.

Next, a state in which the developing unit 240 is moved at the non-driving side to the extent that the connecting member 254L is contacted to the other end 260*e* of the opening 260 is shown in (a) of FIG. 14. In this state, in the case where the cartridge 202 is mounted in the main assembly, the side member 255L provided at the non-driving side of the developing unit 240 is moved apart from the image bearing member unit 250. Therefore, the developing roller 241 supported by the side member 255L receives, at the non-driving side, the force in the direction in which the developing roller 241 is spaced from the photosensitive drum 220, so that the D pressure is decreased. The D pressure in this state is indicated by a broken line (b) in FIG. 13. At the non-driving side (one end side), the D pressure is decreased from that in the normal state of the cartridge 202 by a charge amount Hd.

Next, the case where the cartridge 202 is mounted in the main assembly in a state ((c) of FIG. 14) in which a force is applied to the developing unit 240 to move the developing unit 240 to the extent that the connecting member 254L is contacted to one end 260*d* of the opening 260 is assumed. In this state, the side member 255L provided at the non-driving side of the developing unit 240 is moved in the direction in which the side member 255L approaches the image bearing member 250. At the non-driving side, the developing roller 241 supported by the side member 255L receives the force in the direction in which the developing roller 241 approaches the photosensitive drum 220, so that the D pressure is increased. The D pressure in this state is indicated by a thin line (c) in FIG. 13. At the non-driving side (one end side), the D pressure is increased from that in the normal state of the cartridge 202 by a change amount Hu.

That is, in the cartridge 202 in Comparative Embodiment, in the case where the force is externally applied and thus the developing unit 240 is moved, the D pressure is fluctuated by H1=Hd+Hu.

Further, in the case where the engaging position between the connecting member 254L and the elongated hole (opening) 260 is moved, in order to return the engaging position to the original position, there is a need to take countermeasure such that the frictional force applied between the connecting member 254L and the opening 260 is reduced by, e.g., applying grease to the boundary of the opening 260 during manufacturing of the process cartridge. However, this countermeasure constitutes a factor of complification of a cartridge manufacturing step.

Constitution of Opening in Embodiment 1

In the cartridge 2 in Embodiment 1, even in the case where the force is externally applied to the developing unit 40 and thus the engaging position between the connecting member 54L and the opening 60 is moved to the end of the opening 60, the shape of the opening 60 is determined so as to generate a force for returning the engaging position to the original position.

The action of the opening 60 in Embodiment 1 will be described with reference to FIGS. 15 to 17 and 33.

As shown in (b) of FIG. 33, in this embodiment, with respect to the longitudinal direction of the opening 60, i.e., the direction in which the engaging position between the connecting member 54L and the opening 60 is movable, both ends of the opening 60 are inclined with respect to the central portion. In this case, the surface formed at the central portion of the opening 60 contacting the connecting member 54L is a first contact portion 60*a*. Further, surfaces which are adjacent to the first contact portion 60*a* and are inclined with respect to the first contact portion 60*a* are second contact portions 60*b* and 60*c*.

For clarification of the engaging state of the opening 60 and the connecting member 54L, FIG. 17 is a schematic view for illustrating the shape of the opening 60. In this embodiment, as shown in FIG. 17, a range W in which the connecting member 54L can move in the opening 60 in a contact state to the first contact portion 60*a* was 0.5 mm. Similarly, in the state in which the connecting member 54L contacts the second contact portions 60*b* and 60*c*, ranges Wb and Wc in which the connecting member 54L can move in the opening 60 were similarly 0.5 mm. The diameter in cross-section of the connecting member 54L was 3 mm similarly as in Comparative Embodiment.

Here, the first contact portion 60*a* is a flat surface determined to provide an angle θ7*a*, formed between the flat surface and the horizontal surface, so as to satisfy the formula (5) described above. Particularly, in this embodiment, θ7*a*=θopt was satisfied. As described above, in the case where the cartridge 2 is mounted in the main assembly 1, when the connecting member 54L contacts the first contact portion 60*a* at the angle θ7*a* satisfying: θmin<θ7*a*<θmax, the forces exerted on the developing unit 40 are balanced. That is, the force for moving the engaging position between the connecting member 54L and the opening 60 is not generated. Therefore, when the connecting member 54L contacts the first contact portion 60*a*, the developing unit 40 is rotationally movable relative to the image bearing member unit 50 with the connecting member 54L as a shaft (axis) of rotation.

On the other hand, the second contact portions 60*b* and 60*c* are flat surfaces formed at angles θ7*b* and θ7*c*, respectively, formed so as to be outside the range of the formula (5). That is, θ7*b*>θmax and θ7*c*<θmin are satisfied. When the connecting member 54L is contacted to the second contact portion 60*b* or 60*c*, by the resultant force of the forces applied to the developing unit 40, the opening 60 is moved relative to the connecting member 54L.

More specifically, when the force is applied from the outside to the developing unit 40 and thus the developing unit 40 is moved away from the image bearing member unit 50 at the non-driving side, as shown in (a) of FIG. 15, the connecting member 54L contacts the second contact portion 60*b* provided at the other end 60*e* side of the opening 60. At this time, to the developing unit 40, the force Fa which is the sum total of the forces F1 to F5, and the normal reaction F6*b* received by the second contact portion 60*b* from the connecting member 54L are applied. By applying the forces Fa and F6*b*, a force Fb is generated in a direction parallel to the surface of the second contact portion 60*b*.

At this time, the second contact portion 60*b* is disposed so that the direction of the normal reaction F6*b* is, with respect to the normal reaction F6*a* received by the first contact portion 60*a* when the first contact portion 60*a* contacts the connecting member 54L, inclined so as to spaced from the first contact portion 60*a*. Further, the second contact portion 60*b* is disposed so that the angle θ7*b* formed between the second contact portion 60*b* and the horizontal surface is not included in the range of the formula (5) and satisfies: θ7*b*>θmax. The direction of the force Fb generated by this setting is such that the side member 55L of the developing unit 40 at the non-driving side is moved so that the other end 60*e* of the opening 60 is moved apart from the connecting member 54L.

The angle θ7*a* formed by the second contact portion 60*b* is set so that the value of the force Fb applied to the developing unit 40 exceeds the maximum static frictional force received by the second contact portion 60*b* from the connecting member 54L. As shown in (b) of FIG. 15, the side member 55L of the developing unit 40 at the non-driving side is moved in the direction, in which the force Fb is generated, until the connecting member 54L contacts the first contact portion 60*a*. That is, even when the force is externally applied and the developing unit 40 is moved away from the image bearing member unit 50 at the non-driving side, the opening 60 is moved relative to the connecting member 54L so that the position of the developing unit 40 is returned to the original position. In the state in which the connecting member 54L contacts the first contact portion 60*a*, the first contact portion 60*a* receives the normal reaction F6*a* from the connecting member 54L, so that the forces applied to the developing unit 40 are balanced. That is, movement of the developing unit 40 relative to the image bearing member unit 50 is suppressed.

Similarly, as shown in (a) and (b) of FIG. 16, at one end 60*d* side of the opening 60, the second contact portion 60*c* inclined with respect to the first contact portion 60*a* is provided.

When the force is applied from the outside to the developing unit 40 and thus the developing unit 40 is moved toward the image bearing member unit 50 at the non-driving side, as shown in (a) of FIG. 16, the connecting member 54L contacts the second contact portion 60*c* of the opening 60. At this time, to the developing unit 40, the force Fa and the normal reaction F6*b* are applied, so that the angle θ7*c* is set so as to generate a force Fc is for moving the developing unit 40. That is, the second contact portion 60*c* is disposed so that the direction of the normal reaction F6*c* received by the second contact portion 60*c* from the connecting member 54L is, with respect to the normal reaction F6*a* received by the first contact portion 60*a* from the connecting member 54L, inclined so as to spaced from the first contact portion 60*a*. Further, the second contact portion 60*c* is disposed so that the angle θ7*c* formed between the second contact portion 60*c* and the horizontal surface satisfies: θ7*c*<θmin and is not included in the range of the formula (5). The value of the force Fc generated at this setting exceeds the maximum static frictional force received by the second contact portion 60*c* from the connecting member 54L. When the second contact portion 60*c* contacts the connecting member 54L, as shown in (b) of FIG. 16, the side member 55L of the developing unit 40 at the non-driving side is moved in the direction of the force Fb until the connecting member 54L contacts the first contact portion 60*a*. That is, even when the developing unit 40 is moved toward the image bearing member unit 50 at the non-driving side by the externally applied force, the opening 60 is moved relative to the connecting member 54L so that the position of the moved developing unit 40 is returned to the original position.

An effect achieved by the cartridge 2 in Embodiment 1 will be described with reference to FIG. 18.

FIG. 18 is a graph showing a fluctuation in D pressure in Embodiment 1. In the graph, the abscissa represents the positional deviation amount between the connecting members 54L and 54R. That is, when the connecting members 54L and 54R are viewed from the axial direction of the photosensitive drum 20, with respect to the direction from the center of the photosensitive drum 20 toward the center of the developing roller 41, the position of the connecting member 54L when the position of the connecting member 54R is the reference position is shown. The ordinate in the graph represents the change amount of the D pressure with respect to the reference value. Similarly as in Comparative Embodiment, the fluctuation in D pressure is observed at a point (the position of −0.2 on the abscissa in the graph of FIG. 18) at which the position of the connecting member 54L is deviated from the connecting member 54R by 0.2 mm in the direction in which the developing roller 41 approaches the photosensitive drum 20.

In the case where the engaging position between the connecting member 54L and the opening 60 is moved toward the other end 60*e* side of the opening 60 by the external application of the force to the developing unit 40 and thus the developing unit 40 is moved apart from the image bearing member unit 50 at the non-driving side, the D pressure of the developing roller 41 is decreased at the non-driving side. Incidentally, the D pressure at the driving side is increased correspondingly to the decrease at the non-driving side. In this case, the D pressure at the non-driving side is indicated by a broken line (b) in FIG. 18.

On the other hand, when the engaging position between the connecting member 54L and the opening 60 is moved toward one end 60*d* side of the opening 60 by the external application of the force to the developing unit 40 and thus the developing unit 40 is moved toward the image bearing member unit 50 at the non-driving side, the D pressure of the developing roller 41 is increased at the non-driving side. Incidentally, the D pressure at the driving side is decreased correspondingly to the increase at the non-driving side. In this case, the D pressure at the non-driving side is indicated by a solid (thick) line (c) in FIG. 18.

As shown in FIG. 18, the change amount of the D pressure by the movement of the developing unit 40 at the non-driving side is H2 which is smaller than the change amount H1 (FIG. 13) in Comparative Embodiment. Thus, it is understood that the fluctuation in D pressure is suppressed in Embodiment 1.

This is because the force for moving the developing unit 40 is generated, even in the case where the developing unit 40 at the non-driving side is moved by the externally applied force and thus the engaging position between the connecting member 54L and the opening 60 is moved, in the direction in which the moved engaging position is returned to the original position. That is, even when the developing unit 40 is moved and thus the engaging position between the connecting member 54L and the opening 60 is shifted to one end 50*d* side or the other end 60*e* side of the opening 60, the force for returning the moved engaging position to the original position acts. For that reason, the developing unit 40 is not largely moved relative to the image bearing member unit 50, so that the D pressure fluctuation can be suppressed.

Actually, as is understood from comparison between the graphs of FIGS. 13 and 18, in the range from −0.2 mm to 0.4 mm as the positional deviation range of the connecting member 54L from the connecting member 54R, a degree of the D pressure fluctuation in Embodiment 1 is smaller than that in Comparative Embodiment.

According to Embodiment 1, the D pressure is stabilized at both longitudinal end portions. For that reason, at the end portions of the developing roller 41, the spacing members 48R and 48L are stably contacted to the photosensitive drum 20, so that it is possible to keep the gap between the developing roller 41 surface and the photosensitive drum 20 surface at a constant level.

It is possible to suppress the spacing of the developing roller 41 from the photosensitive drum 20 due to the decrease in D pressure and suppress abrasion (wearing) of the spacing members 48 and load application to the cartridge 2 due to the increase in D pressure.

Further, in this embodiment, in the case where the developing unit 40 is moved by the external application of the force and thus the engaging position between the opening 60 and the connecting member 54L, as the force for returning the moved engaging position to the original position, the driving force of the main assembly 1 is not required. For that reason, the load is not exerted on the motor in order to stabilize the D pressure. Therefore, it becomes possible to suppress an increase in torque during actuation of the image forming apparatus.

Further, in order to return the engaging position between the connecting member 54L and the opening 60 to the original position, there is no need to take the countermeasure that the grease is applied into the opening 60. For that reason, the cartridge manufacturing step is simplified to facilitate automation of the manufacturing.

Further, even when the position of the connecting member 54L is deviated from the position of the connecting member 54R, the connecting member 54L is kept in a state in which the connecting member 54R is spaced from the both ends of the opening 60. Therefore, it becomes possible to suppress the abrupt fluctuation in D pressure caused by application of the force to one end 60*d* or the other end 60*e* of the opening 60 by the connecting member 54L.

Further, in order to further smoothly move the engaging position between the connecting member 54L and the opening 60, the connecting portion of each contact portion may also be formed in a curved surface-like shape.

Incidentally, the image contact portion 60*a* and the second contact portions 60*b* and 60*c* are not necessarily connected with each other but may only be required that the engaging position between the connecting member 54L and the opening 60 is movable from the second contact portion 60*b* or 60*c* to the first contact portion 60*a*. For example, with respect to the axial direction of the photosensitive drum 20, the position of the first contact portion 60*a* and the position of the second contact portion 60*b* (60*c*) may also be spaced from each other.

Embodiment 2

Embodiment 2 will be described with reference to FIGS. 34, 19 and 20.

Part (a) of FIG. 34 is a side view showing a part of the developing unit 40 in this embodiment. Part (b) of FIG. 34 is an enlarged view of the opening 60 provided in the developing unit 40 shown in (a) of FIG. 34. In this embodiment, as shown in (b) of FIG. 34, the opening 60 is characterized by having a curved surface shape at a position contacted to the connecting member 54L.

For clarification of the engaging state between the opening 60 and the connecting member 54L, the shape of the opening 60 in this embodiment is schematically shown in FIG. 19.

Similarly as in Embodiment 1, when the connecting member 54L is contacted, an area in which the forces applied to the developing unit 40 are balanced is the first contact portion. When the connecting member 54L is contacted to the first contact portion, the developing unit 40 is rotationally movable relative to the image bearing member unit 50 with the connecting member 54L as the rotation axis (shaft) (first axis (shaft)). On the other hand, when the connecting member 54L is contacted, an area in which the developing unit 40 is moved until the connecting member 54L is contacted to the first contact portion is the second contact portion.

As shown in FIG. 19, the area in which the angle θ7 formed between the tangential line of the contact portion contacting the connecting member 54L and the horizontal surface satisfies the formula (5) (the area in which $\theta min<\theta 7<\theta max$ is satisfied) is the first contact portion. Further, the area in which the angle θ7 does not satisfy the formula (5) (the area in which $\theta 7<\theta min$ or $\theta 7>\theta max$ is satisfied) is the second contact portion.

In this embodiment, when the opening 60 is viewed from the axial direction of the photosensitive drum 20, the opening 60 is provided so as to have an arcuate portion at which the tangential line provide angles θ7*a* (=θopt), θ7*b* (>θmax) and θ7*c* (<θmin). A length (width) W of the opening 60 is about 4.5 mm.

The D pressure fluctuation in Embodiment 2 will be described with reference to FIG. 20. FIG. 20 is a graph showing the D pressure fluctuation in this embodiment. In FIG. 20, the broken line (b) shows the D pressure when the engaging position between the opening 60 and the connecting member 54L is shifted toward the other end 60*e* side of the opening 60 by the external application of the force to the developing unit 40. Further, the solid (thick) line in FIG. 20 shows the D pressure when the engaging position between the opening 60 and the connecting member 54L is shifted toward one end 60*d* side of the opening 60 by the external application of the force to the developing unit 40.

Also in this embodiment, in the case where the engaging position between the connecting member 54L and the opening 60 is shifted toward the other end 60*e* side of the opening 60 and thus the developing unit 40 is moved apart from the image bearing member unit 50 at the non-driving side, the D pressure of the developing roller 41 is decreased at the non-driving side (broken line (b) in FIG. 20).

On the other hand, in the case where the engaging position is shifted toward one end 60*d* side and thus the developing unit 40 approaches the image bearing member unit 50 at the non-driving side, the D pressure is increased at the non-driving side (solid line (c) of FIG. 20).

However, when the D pressures in FIGS. 13 and 20 are compared, it is understood that the change amount H3 of the D pressure in this embodiment is smaller than the change amount H1 of the D pressure in Comparative Embodiment. That is, also in this embodiment, movement of the engaging position between the connecting member 54L and the opening 60 to one end 60*d* side or the other end 60*e* side is suppressed, so that the D pressure fluctuation is suppressed. Further, when FIG. 18 which is the graph of the D pressure in Embodiment 1 and FIG. 20 which is the graph of the D pressure in this embodiment are compared, it is understood that a degree of the D pressure fluctuation along the abscissa direction in this embodiment is smaller than that in Embodiment 1. This may be attributable to smooth movement of the opening 60 relative to the connecting member 54L to a position, in which the D pressure is stabilized, based on the curved surface of the contact portions of the opening 60 even in the case where the position of the connecting member 54L is largely deviated from the position of the connecting member 54R.

Embodiment 3

In Embodiments 1 and 2, with respect to the direction in which the engaging position between the opening 60 and the connecting member 54L is moved, the second contact portions 60*b* and 60*c* are provided at both sides of the first contact portion 60*a*. However, the surface contact portions are not necessarily required to be provided at both sides of the first contact portion 60*a*. Depending on handling or the like by the user, the effect of the present invention is also achieved by providing the second contact portion only at a position where there is a high possibility that the engaging position between the connecting member 54L and the opening 60 is moved. In FIG. 21, as an example, the opening 60 provided with the second contact portion 60*c* only at one end 60*d* side of the opening 60 is shown as a schematic schematic view. In this case, when the user mounts the cartridge 2 into the main assembly 1, the developing unit 40 is pressed against the image bearing member unit 50. As a result, in the case where the engaging position between the connecting member 54L and the opening 60 is moved toward one end 60*d* side of the opening 60, the effect of returning the moved engaging position to the original position is obtained. That is, when the user mounts the cartridge 2 into the main assembly 1, it is possible to suppress the increase in D pressure at the non-driving side.

On the other hand, in the case where the second contact portion is provided at the other end 60*e* side of the opening 60, it is possible to suppress the decrease in D pressure caused by the movement of the engaging position between the connecting member 54L and the opening 60 toward the other end 60*e* side of the opening 60.

Incidentally, in Embodiments 1 to 3, the opening 60 has the elongated hole shape but the present invention is not limited thereto. The opening may only be required to provide the first contact portion and the second contact portion and may also have another shape such that a cut-away portion is provided by cutting away a part of the arm portion 55*a*L.

Further, in Embodiments 1 to 3, the connecting member 54L provided to the image bearing member unit 50 is engaged with the opening 60. However, as shown in FIG. 22, in place of the connecting member 54L, a projection 50*a* integrally formed with the image bearing member unit 50 may also be engaged with the opening 60 as a shaft (axis) (first shaft (axis)). In this case, the developing unit is rotatably (movably) supported by the image bearing member unit with the projection 50*a* as the rotation shaft.

Embodiment 4

With reference to (a) and (b) of FIG. 23, this embodiment in which the opening 60 is provided in the image bearing member unit will be described. Part (a) of FIG. 23 is a perspective view for illustrating the cartridge in this embodiment. Part (b) of FIG. 23 is an enlarged view of an area A indicated by an enclosed broken line in (a) of FIG. 23. That is, (b) of FIG. 23 is the enlarged view of the opening provided in the cartridge.

In Embodiments 1 to 3, the opening 60 is provided in the developing unit 40 and the shaft (first shaft) engaged with the opening 60 is provided in the image bearing member unit 50. However, as shown in (a) of FIG. 23, the opening 60 may also be provided at the image bearing member unit 50 side. As shown in (b) of FIG. 23, in this embodiment, a projection 40*c* provided at the developing unit 40 side is engaged, as the first shaft, with the opening 60 provided in the image bearing member unit 50. Incidentally, in this embodiment, different from Embodiments 1 to 3, the projection 40*c* is movably configured relative to the opening 60. Further, in this embodiment, compared with the case where the opening 60 is provided in the developing unit 40, the bending direction of the opening 60 in this embodiment is opposite from that in Embodiments 1 to 3.

In this embodiment, when the projection 40*c* is contacted to the second contact portion 60*b* or 60*c* of the opening 60, the projection 40*c* is moved by receiving the normal reaction from the second contact portion 60*b* or 60*c*, so that the projection 40*c* is contacted to the first contact portion 60*a*. That is, even when the developing unit 40 receives the force from the outside, the state in which the projection 40*c* is contacted to the first contact portion 60*a* of the opening 60 is kept, so that the D pressure fluctuation is suppressed.

That is, in order to suppress the D pressure fluctuation, the shaft (first shaft) is provided to either one of the image bearing member unit and the developing unit and the opening engaged with the shaft may be provided to the other unit.

Incidentally, with respect to the opening 60 shown in (b) of FIG. 23, similarly as in Embodiment 1, each of the first contact portion and the second contact portion is formed in the flat surface shape but may also be formed in the curved surface shape.

Embodiment 5

In Embodiments 1 to 4, the present invention is described by taking the non-contact development type cartridge as an example but may also be carried out by using a contact development type cartridge 2 as shown in FIG. 25. Parts (a) and (b) of FIG. 24 are schematic views showing a contact state between the photosensitive drum 20 and the developing roller 41 in the contact development type cartridge 2. In the case of the cartridge employing the contact development type as a development type, as shown in (a) of FIG. 24, the developing roller 41 is directly contacted to the photosensitive drum 20, so that the developing roller 41 is constituted by coating a core metal with an elastic member 71 of a rubber material or the like. Here, as shown in (b) of FIG. 24, when the drum 20 contacts the elastic member 71 of the developing roller 41, in order to regulate an impression (entering) depth (amount) d of the drum 20 into the elastic member 71, impression depth regulating members 70L and 70R are used. The impression depth regulating members 70L and 70R are a cylindrical member provided on the core metal at each of the both longitudinal end portions of the developing roller 41 and are contacted to the drum 20 during image formation. At this time, the force applied from each of the impression depth regulating members 70L and 70R is the D pressure.

Also in the cartridge 2 of the contact development type, the opening 60 is provided with the first contact portion and the second contact portion, so that it is possible to stabilize the pressure of the developing roller 41 exerted on the photosensitive drum 20.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 198777/2010 filed Sep. 6, 2010 and 171109/2011 filed Aug. 4, 2011, which are hereby incorporated by reference.

What is claimed is:

1. A process cartridge detachably mountable to an apparatus main assembly of an image forming apparatus, comprising:

an image bearing member unit including an image bearing member rotatably provided; and a developing unit, including a developer carrying member to be urged toward the image bearing member, connected rotationally movably to said image bearing member unit by a connecting portion, wherein the connecting portion includes a shaft provided in one of said image bearing member unit and said developing unit in an end side of said process cartridge with respect to an axial direction of said image bearing member, and includes an engaging portion which is provided in another one of said image bearing member unit and said developing unit in the end side and which is contacted to said shaft, wherein said engaging portion includes a first contact portion contacted to said shaft to permit rotational movement of said developing unit relative to said image bearing member unit, and includes a second contact portion, where said shaft is slidably movable relative thereto, which receives normal reaction B from said shaft in a direction inclined with respect to a direction of normal reaction A received from said shaft by the first contact portion and which moves, when the second contact portion contacts said shaft, said developing unit relative to said image bearing member unit to a contact position of said shaft and the first contact portion, and wherein the normal reaction B or its reaction force is a component of a force for moving said shaft toward the first contact portion relative to the first contact portion.

2. A process cartridge according to claim 1, further comprising:

a first gear provided to the image bearing member in another end side of said process cartridge with respect to the axial direction; and a second gear, provided to the image bearing member in another end portion, for being engaged with said first gear to receive a driving force.

3. A process cartridge according to claim 1, wherein the second contact portion is disposed at each of ends of the first contact portion with respect to a direction in which said shaft is moved relatively along the first contact portion.

4. A process cartridge according to claim 3, wherein the two second contact portions disposed at the ends of the first contact portion are constituted so that the normal reaction B received from said shaft by one of the second contact portions and the normal reaction B received from said shaft by another one of the second contact portions are directed in mutually spaced directions.

5. A process cartridge according to claim 1, wherein the second contact portion is disposed only in an end side of the first contact portion with respect to a direction in which said shaft is moved relatively along the first contact portion.

6. A process cartridge according to claim 1, wherein the first contact portion and the second contact portion are constituted so that the normal reaction A and the normal reaction B are directed in mutually spaced directions.

7. A process cartridge according to claim 1, wherein a connecting portion between the first contact portion and the second contact portion is a curved surface.

8. A process cartridge according to claim 1, wherein the first contact portion and the second contact portion are a curved surface.

9. A process cartridge according to claim 1, wherein the second contact portion contacted to said shaft is mounted in the apparatus main assembly and moves, in a state in which the second contact portion does not receive the driving force from the apparatus main assembly to the image bearing member and the developer carrying member, said developing unit relative to said image bearing member unit to the contact position of said shaft and the first contact portion.

10. A process cartridge according to claim 1, further comprising an urging member for urging the developer carrying member against the image bearing member.

11. An image forming apparatus for forming an image on a recording material, comprising:

a process cartridge according to claim 1; and supporting means for supporting said process cartridge detachably at a position for effecting image formation, wherein said supporting means supports said process cartridge in an attitude in which a force for moving said developing unit to the contact position of said shaft and the first contact portion is generated at the second contact portion contacted to said shaft.

* * * * *